US005657043A

United States Patent [19]

Fukui et al.

[11] Patent Number: 5,657,043

[45] Date of Patent: Aug. 12, 1997

[54] DRIVING APPARATUS FOR LIQUID CRYSTAL DISPLAY

[75] Inventors: Yasuhito Fukui, Uji; Tokikazu Matsumoto, Osaka, both of Japan

[73] Assignee: Matsushita Electric Industrial Co., Ltd., Osaka, Japan

[21] Appl. No.: 423,723

[22] Filed: Apr. 18, 1995

[30] Foreign Application Priority Data

Apr. 18, 1994 [JP] Japan ..... 6-078345

[51] Int. Cl.[6] ..... G09G 3/36

[52] U.S. Cl. ..... 345/100; 345/94

[58] Field of Search ..... 345/55, 87, 94, 345/95, 98, 100, 190, 201, 204, 208, 210; 359/54, 55, 56; 382/281

[56] References Cited

U.S. PATENT DOCUMENTS 5,459,495 10/1995 Scheffer et al. ..... 345/89

FOREIGN PATENT DOCUMENTS 0 507 061 10/1993 European Pat. Off. .
A-621578 10/1994 European Pat. Off. .

OTHER PUBLICATIONS

"Active Adressing™ of STN displays for high–performance video applications",*Displays,* vol. 14, No. 2, 1993, pp. 74–85.

SID International Symposium 1994—Digest of Technical Papers, vol. 25, May 1994, Santa Ana, CA, pp. 69–72, XP 000439087, Fukui et al., "A study of the active drive method for STN LCDs".

"Optimum Row Functions and Algorithms for Active Addressing", SID 93 Digest, pp. 89–92, B. Clifton, et al.

*Primary Examiner*—Richard Hjerpe
*Assistant Examiner*—Kara Farnandez Stoll
*Attorney, Agent, or Firm*—Wenderoth, Lind & Ponack

[57] ABSTRACT

A driving apparatus for driving a passive matrix liquid crystal display utilizing an active driving method includes an image buffer storage for storing one frame of image data in the form of a matrix to output image data on a column by column basis to produce a rearranged image data. A matrix generator generates row data. A data converter multiplies the rearranged image data with row vectors to produce converted data. A converted data buffer storage stores the converted data and outputs the data on a row by row basis to produce a column data. A LCD driver is provided for producing a column signal based on the column data and a row signal based on the row data, and further for applying these row and column signals to row and column electrodes, respectively, to drive the LCD.

7 Claims, 22 Drawing Sheets

Sv
100
1
Frame buffer storage
S1
2
Column buffer storage
S100 (S2)
300
4
Column register
S4
5
Calculator
S300
6
Column buffer storage
S6
7
Frame buffer storage
400
S400
500
D/A converter
8
S8
Column driver
9
S9
STN-LCD
14
S13
Row driver
13
S12
Row voltage register
12
S11
Distributor
11
S3 (Sl)
S3(Sm)
Matrix generator
3

100
2
1
Sv
101
Sub frame selector
S107
L3
107
Address generator
102
S102
Sub frame memory
103
S103
Sub frame memory
104
S104
Sub frame memory
105
S105
Sub frame memory
S108
108
Counter
106
Sub frame selector
S1
20
SW3
SW4
L4
L5
161
Reading address generator
162
Writing address generator
164
Column memory
165
Column memory
S100
30
Hsync.

| | | | |
|---|---|---|---|
| 0 | 4 | 8 | 12 |
| 1 | 5 | 9 | 13 |
| 2 | 6 | 10 | 14 |
| 3 | 7 | 11 | 15 |

Fig.25

$$\underset{50}{\begin{bmatrix} 1 & 1 & 0 & 0 & 0 & 0 \\ 0 & 0 & 1 & 1 & 0 & 0 \\ 0 & 0 & 0 & 0 & 1 & 1 \\ 1 & -1 & 0 & 0 & 0 & 0 \\ 0 & 0 & 1 & -1 & 0 & 0 \\ 0 & 0 & 0 & 0 & 1 & -1 \end{bmatrix}} \times \underset{51}{\begin{bmatrix} a_{1,1} & a_{1,2} & a_{1,3} & a_{1,4} & a_{1,5} & a_{1,6} \\ a_{2,1} & a_{2,2} & a_{2,3} & a_{2,4} & a_{2,5} & a_{2,6} \\ a_{3,1} & a_{3,2} & a_{3,3} & a_{3,4} & a_{3,5} & a_{3,6} \\ a_{4,1} & a_{4,2} & a_{4,3} & a_{4,4} & a_{4,5} & a_{4,6} \\ a_{5,1} & a_{5,2} & a_{5,3} & a_{5,4} & a_{5,5} & a_{5,6} \\ a_{6,1} & a_{6,2} & a_{6,3} & a_{6,4} & a_{6,5} & a_{6,6} \end{bmatrix}} = \underset{52}{\begin{bmatrix} b_{1,1} & b_{1,2} & b_{1,3} & b_{1,4} & b_{1,5} & b_{1,6} \\ b_{2,1} & b_{2,2} & b_{2,3} & b_{2,4} & b_{2,5} & b_{2,6} \\ b_{3,1} & b_{3,2} & b_{3,3} & b_{3,4} & b_{3,5} & b_{3,6} \\ b_{4,1} & b_{4,2} & b_{4,3} & b_{4,4} & b_{4,5} & b_{4,6} \\ b_{5,1} & b_{5,2} & b_{5,3} & b_{5,4} & b_{5,5} & b_{5,6} \\ b_{6,1} & b_{6,2} & b_{6,3} & b_{6,4} & b_{6,5} & b_{6,6} \end{bmatrix}}$$

Fig.26

$$\underset{53}{\begin{bmatrix} 1 & 1 & 0 & 0 & 0 & 0 \\ 1 & -1 & 0 & 0 & 0 & 0 \\ 0 & 0 & 1 & 1 & 0 & 0 \\ 0 & 0 & 1 & -1 & 0 & 0 \\ 0 & 0 & 0 & 0 & 1 & 1 \\ 0 & 0 & 0 & 0 & 1 & -1 \end{bmatrix}} \times \underset{51}{\begin{bmatrix} a_{1,1} & a_{1,2} & a_{1,3} & a_{1,4} & a_{1,5} & a_{1,6} \\ a_{2,1} & a_{2,2} & a_{2,3} & a_{2,4} & a_{2,5} & a_{2,6} \\ a_{3,1} & a_{3,2} & a_{3,3} & a_{3,4} & a_{3,5} & a_{3,6} \\ a_{4,1} & a_{4,2} & a_{4,3} & a_{4,4} & a_{4,5} & a_{4,6} \\ a_{5,1} & a_{5,2} & a_{5,3} & a_{5,4} & a_{5,5} & a_{5,6} \\ a_{6,1} & a_{6,2} & a_{6,3} & a_{6,4} & a_{6,5} & a_{6,6} \end{bmatrix}} = \underset{54}{\begin{bmatrix} b_{1,1} & b_{1,2} & b_{1,3} & b_{1,4} & b_{1,5} & b_{1,6} \\ b_{4,1} & b_{4,2} & b_{4,3} & b_{4,4} & b_{4,5} & b_{4,6} \\ b_{2,1} & b_{2,2} & b_{2,3} & b_{2,4} & b_{2,5} & b_{2,6} \\ b_{5,1} & b_{5,2} & b_{5,3} & b_{5,4} & b_{5,5} & b_{5,6} \\ b_{3,1} & b_{3,2} & b_{3,3} & b_{3,4} & b_{3,5} & b_{3,6} \\ b_{6,1} & b_{6,2} & b_{6,3} & b_{6,4} & b_{6,5} & b_{6,6} \end{bmatrix}}$$

Fig.27

55 $\begin{bmatrix} 1 & 1 \\ 1 & -1 \end{bmatrix} \times \begin{bmatrix} a_{1,1} & a_{1,2} & a_{1,3} & a_{1,4} & a_{1,5} & a_{1,6} \\ a_{2,1} & a_{2,2} & a_{2,3} & a_{2,4} & a_{2,5} & a_{2,6} \end{bmatrix}$ 56 $= \begin{bmatrix} b_{1,1} & b_{1,2} & b_{1,3} & b_{1,4} & b_{1,5} & b_{1,6} \\ b_{4,1} & b_{4,2} & b_{4,3} & b_{4,4} & b_{4,5} & b_{4,6} \end{bmatrix}$ 57

58 $\begin{bmatrix} 1 & 1 \\ 1 & -1 \end{bmatrix} \times \begin{bmatrix} a_{3,1} & a_{3,2} & a_{3,3} & a_{3,4} & a_{3,5} & a_{3,6} \\ a_{4,1} & a_{4,2} & a_{4,3} & a_{4,4} & a_{4,5} & a_{4,6} \end{bmatrix}$ 59 $= \begin{bmatrix} b_{2,1} & b_{2,2} & b_{2,3} & b_{2,4} & b_{2,5} & b_{2,6} \\ b_{5,1} & b_{5,2} & b_{5,3} & b_{5,4} & b_{5,5} & b_{5,6} \end{bmatrix}$ 60

61 $\begin{bmatrix} 1 & 1 \\ 1 & -1 \end{bmatrix} \times \begin{bmatrix} a_{5,1} & a_{5,2} & a_{5,3} & a_{5,4} & a_{5,5} & a_{5,6} \\ a_{6,1} & a_{6,2} & a_{6,3} & a_{6,4} & a_{6,5} & a_{6,6} \end{bmatrix}$ 62 $= \begin{bmatrix} b_{3,1} & b_{3,2} & b_{3,3} & b_{3,4} & b_{3,5} & b_{3,6} \\ b_{6,1} & b_{6,2} & b_{6,3} & b_{6,4} & b_{6,5} & b_{6,6} \end{bmatrix}$ 63

DRIVING APPARATUS FOR LIQUID CRYSTAL DISPLAY

BACKGROUND OF THE INVENTION

1. Field of the Invention

The present invention relates to a driving apparatus for a liquid crystal display utilizing an addressing technique effective to permit a fast responding STN (Super Twisted Nematic) passive matrix liquid crystal display to provide images of high contrast.

2. Description of the Prior Art

The liquid crystal display is currently used as one type of flat panel display, and an exemplary type of which is an STN passive matrix liquid crystal display (hereinafter referred to as "STN LCD") as shown in FIG. 22. This STN LCD is of a simple structure including a glass substrate unit 223 having first and second halves 223A and 223B opposed to each other. The first half substrate 223A is provided with a first electrodes 221 comprised of a plurality of transparent and striped-shaped electrodes 221 formed on one surface thereof to extend in a first direction. Similarly, the second half substrate 223B is provided with a plurality of transparent and striped-shaped second electrodes 222 extending in a second direction on the surface opposed to the first electrodes 221.

These glass substrate halves 223A and 223B are assembled such that the first electrodes 221 extend in a traverse direction perpendicular to the second direction to thereby form a matrix of row and column electrodes together with the second electrodes 222. Hereinafter, the first and second electrodes 221 and 222 are referred to as "row electrodes" and "column electrodes", respectively. A layer 224 of liquid crystal material tightly sandwiched between the first and second glass substrate halves 223A and 223B. Due to this peculiar structure, the STN LCD has an advantage in that it is inexpensive to make. With the advent of an STN LCD having a fast responding characteristics and capable of displaying time-varying image of a video-rate, various fields in which the STN LCD may be applied are now expanding.

However, it has been found that the fast responding STN passive matrix type LCD is susceptible to a considerable reduction in image contrast if it is driven by the use of the conventional driving technique in which a select voltage is applied at a time to one of the row electrodes 221 during one frame period while information to be applied to pixels aligned with such one of the row electrodes 221 is supplied through the column electrodes 222. To avoid this considerable reduction in image contrast, a new driving technique called as an active driving method has been suggested to improve the image contrast exhibited by the STN passive matrix LCD by selecting the plural row electrodes 221 simultaneously at a time and selecting a number of times one of the row electrodes during one frame period.

With reference to FIG. 23, the detail of this active driving method is described below. First, row signal supplied to the row electrodes 221 is described. An orthogonal matrix 231 consists of a data of binary digits of "+1" and "−1" or a data of three binary digits of "+1", "0", and "−1", in which the inner product of arbitrarily chosen two different ones of the column vector forming parts of the matrix necessarily be zero. Of the data having this matrix, the voltage corresponding to these binary digits "+1" and "−1" is the select voltage for the row electrodes 221. In other words, the same number of row electrodes 221 as the total number of binary digits "+1" and "−1" included in one row vector of the orthogonal matrix 231 are selected simultaneously.

Next, column signal supplied to the column electrodes 222 is described. With respect to a digital image data for each frame to be displayed by the LCD, a product of digital image data 232 times the orthogonal matrix 231 to be used for driving the column electrodes 222 is determined and is then converted into a converted data 233. A voltage proportional to the value of each element of converted data 233 is applied as a column signal to the column electrodes 222.

When the row and column signals are applied to the row and column electrodes 221 and 222, respectively, and effective voltage proportional to each element of the image data 232 is accumulated in each of pixels, whereat the row and column electrodes 221 and 223 intersect, during one frame period. Since respective portions of the liquid crystal layer 224 (FIG. 22) aligned with the pixels permit passage of light therethrough in dependence on the effective voltage between the row and column electrodes 221 and 222, an image can be displayed on the LCD.

This active driving method is disclosed in a paper titled as "Optimum Row Function and Algorithms for Active Addressing" by B. Clifton, D. Prince, B. Leybold, T. J. Scheffer, A. R. Conner,.and B. Greenberg, 1993 SID Digest of Technical Papers, 89–92 (1993). According to this paper, it is described that good contrast and uniformity of image is possible with fewer lines selected at a time, even when compared with the image obtained when all lines are selected at a time. Such a fewer number of lines, reduced from the full number of lines, can be obtained by including the binary digit "0" in the orthogonal matrix 231 comprising the binary digits "+1" and "−1"

Furthermore, among the orthogonal matrixes comprising three binary digits, with the matrix Z' expresses by the following equation (2), the image displayed by LCD is better than that with the matrix Z expressed by the following equation (1).

$$Z=\begin{bmatrix} 1 & 1 & 1 & 1 & 0 & 0 & 0 & 0 & 0 & 0 & 0 & 0 \\ 1 & -1 & 1 & -1 & 0 & 0 & 0 & 0 & 0 & 0 & 0 & 0 \\ 1 & 1 & -1 & -1 & 0 & 0 & 0 & 0 & 0 & 0 & 0 & 0 \\ 1 & -1 & -1 & 1 & 0 & 0 & 0 & 0 & 0 & 0 & 0 & 0 \\ 0 & 0 & 0 & 0 & 1 & 1 & 1 & 1 & 0 & 0 & 0 & 0 \\ 0 & 0 & 0 & 0 & 1 & -1 & 1 & -1 & 0 & 0 & 0 & 0 \\ 0 & 0 & 0 & 0 & 1 & 1 & -1 & -1 & 0 & 0 & 0 & 0 \\ 0 & 0 & 0 & 0 & 1 & -1 & -1 & 1 & 0 & 0 & 0 & 0 \\ 0 & 0 & 0 & 0 & 0 & 0 & 0 & 0 & 1 & 1 & 1 & 1 \\ 0 & 0 & 0 & 0 & 0 & 0 & 0 & 0 & 1 & -1 & 1 & -1 \\ 0 & 0 & 0 & 0 & 0 & 0 & 0 & 0 & 1 & 1 & -1 & -1 \\ 0 & 0 & 0 & 0 & 0 & 0 & 0 & 0 & 1 & -1 & -1 & 1 \end{bmatrix} \quad (1)$$

$$Z'=\begin{bmatrix} 1 & 1 & 1 & 1 & 0 & 0 & 0 & 0 & 0 & 0 & 0 & 0 \\ 0 & 0 & 0 & 0 & 1 & 1 & 1 & 1 & 0 & 0 & 0 & 0 \\ 0 & 0 & 0 & 0 & 0 & 0 & 0 & 0 & 1 & 1 & 1 & 1 \\ 1 & -1 & 1 & -1 & 0 & 0 & 0 & 0 & 0 & 0 & 0 & 0 \\ 0 & 0 & 0 & 0 & 1 & -1 & 1 & -1 & 0 & 0 & 0 & 0 \\ 0 & 0 & 0 & 0 & 0 & 0 & 0 & 0 & 1 & -1 & 1 & -1 \\ 1 & 1 & -1 & -1 & 0 & 0 & 0 & 0 & 0 & 0 & 0 & 0 \\ 0 & 0 & 0 & 0 & 1 & 1 & -1 & -1 & 0 & 0 & 0 & 0 \\ 0 & 0 & 0 & 0 & 0 & 0 & 0 & 0 & 1 & 1 & -1 & -1 \\ 1 & -1 & -1 & 1 & 0 & 0 & 0 & 0 & 0 & 0 & 0 & 0 \\ 0 & 0 & 0 & 0 & 1 & -1 & -1 & 1 & 0 & 0 & 0 & 0 \\ 0 & 0 & 0 & 0 & 0 & 0 & 0 & 0 & 1 & -1 & -1 & 1 \end{bmatrix} \quad (2)$$

The matrix Z of the equation (1) can be obtained by expanding an orthogonal matrix X below expressed by an equation (3) comprised of the binary digits "+1" and "−1" and a unit matrix Y expressed by an equation (4) with the manner expressed by an equation (5) below. The matrix Z' of the equation (2) is obtained by replacing the i-th line of matrix Z with the i'-th line using the i and i' determined based on an equation (6).

$$X=\begin{bmatrix}1 & 1 & 1 & 1\\ 1 & -1 & 1 & -1\\ 1 & 1 & -1 & -1\\ 1 & -1 & -1 & 1\end{bmatrix} \tag{3}$$

$$y=\begin{bmatrix}1 & 0 & 0\\ 0 & 1 & 0\\ 0 & 0 & 1\end{bmatrix} \tag{4}$$

$$Z=\begin{bmatrix}y11X & y12X & \dots & y1mX\\ y21X & y22X & \dots & y2mX\\ \cdot & \cdot & & \cdot\\ \cdot & \cdot & & \cdot\\ \cdot & \cdot & & \cdot\\ ym1X & ym2X & \dots & ymmX\end{bmatrix} \tag{5}$$

$$=\begin{bmatrix}X & 0 & \dots & 0\\ 0 & X & \dots & 0\\ \cdot & \cdot & & 0\\ \cdot & \cdot & & \\ \cdot & \cdot & & \\ 0 & 0 & \dots & X\end{bmatrix}$$

wherein X is a square matrix of "n" order, Y is a square Matrix of "m" order, and Z is a square matrix of "mn" order. When all the elements in the square matrix are zero, Z becomes zero.

$$(i-1)/n+r \dots s \tag{6}$$

and $$i'=s\times m+r+1 \tag{7},$$

wherein "i" and "i'"are natural numbers smaller than "N", "r" is an integer greater than zero but less than "m", and "s" is an integer greater than zero but less than "n". Based on the facts described above, since an orthogonal matrix such as the matrix Z' expressed by the equation (2) is utilized as a row pattern for the row signal of the LCD in the conventional driving apparatus, the same matrix is utilized as the orthogonal matrix to calculate the converted data for driving LCD.

However, utilizing an orthogonal matrix such as the matrix Z enables to calculate the converted data more easier with a calculator constructed in more compact size than utilizing other orthogonal matrix such as the matrix Z'. The converted data can be calculated at the following steps. First, the image data 232 is separated into some portions comprised of elements of plural rows, as shown in FIG. 5. Second, these separated portions are applied with the orthogonal matrix X that is a source of the matrix Z' to convert the elements therein. Third, thus converted elements are combined, and then the aimed converted image 233 can be obtained.

According to the active driving method suggested in the above paper, the LCD can be driven with a good image contrast even reducing the number of lines to be selected at a time with respect to the matrix Z. However, in this case, a calculator in a great scale is necessary for calculating such a complicated process to calculate the aimed image data 233 based on the matrix Z', resulting in the increasing of cost and difficulties of operations. Note that such a great scale of calculator can be replaced with a simpler one, if the matrix Z is used in place of the matrix Z' at the sacrifice of the image contrast.

Further problems with respect to the active driving method other than that suggested in the above paper are available. It is the construction of image buffer storage for temporarily storing the image data 232 and the converted data 233. The computation is carried out to the column vectors of the image data 232 to determine the converted data 233. To describe it with reference to the matrix of the image data 232 shown in FIG. 23, the sequence of reading of each of the image data 232 will be as follows.

$$a_{1,1}\rightarrow a_{2,1}\rightarrow a_{3,1}\rightarrow a_{4,1}\rightarrow a_{1,2}\rightarrow a_{2,2}\rightarrow \dots \rightarrow a_{4,4}$$

On the other hand, the sequence of writing the image data 232 will be as follows.

$$a_{1,1}\rightarrow a_{1,2}\rightarrow a_{1,3}\rightarrow a_{1,4}\rightarrow a_{2,1}\rightarrow a_{2,2}\rightarrow \dots \rightarrow a_{4,4}$$

In other words, the direction of image data reading and the direction of image writing are such as shown in FIGS. 24A and 24B, respectively. In this case, the image data is read out in the direction Dr indicated by arrows in FIG. 24B, and is written in the direction Dw indicated by arrows in FIG. 24A. Since these directions Dr and Dw are different from each other, buffer memory capable of high speed access to the image data 232 with respect to the directions Dr and Dw are required. However, the dynamic random access memory (DRAM) widely used for data storage use can make a high speed access to the data to write in any of these directions Dw and Dr, but can not make a high speed access to read in the direction other than that writing direction. Therefore, DRAM can not be applied for the apparatus for driving LCD, and an expensive memory such as SRAM (static random access memory) which can make a very high speed access both in reading and writing is required.

Furthermore, even when such an expensive and high speed access memory is used as a means of buffer storage for the image data 232, the reading direction Dr and writing direction from Dw are different each other, as described in the above. Therefore, two sets of buffer storage capable of high speed access for temporarily storing the image data 232 and for reading the image data 232, respectively, are necessary. One of buffer storage is only for writing the image data 232 in the direction Dw, and the other is only for reading the image data 232 therefrom in the direction Dr. These two sets of buffer storage are alternately operated for each frame period to receive the image data 232 for each row and to output for each column the image data 232 of the previous frame period, respectively.

On the other hand, while each element of the converted data represents an inner product between the column vector of the image data 232 and the row vector of the orthogonal matrix 231, the row vectors of the orthogonal matrix 231 for each column vector of one of the image data 232 are computed in the sequence from the first row to the last row of the orthogonal matrix and, therefore, the column vectors of the converted image data 233 are prepared in the following sequence.

$$b_{1,1}\rightarrow b_{2,1}\rightarrow b_{3,1}\rightarrow b_{4,1}\rightarrow b_{1,2}\rightarrow b_{2,2}\rightarrow \dots b_{4,4}$$

The converted data 233 so prepared are supplied in units of a single row to the column driver 9, as shown in FIG. 23. Therefore, the sequence of reading is as follows.

$$b_{1,1}\rightarrow b_{2,1}\rightarrow b_{1,3}\rightarrow b_{1,4}\rightarrow b_{2,1}\rightarrow b_{2,2}\rightarrow \dots b_{4,4}$$

Accordingly, even in the case of the converted data, each of the image data buffers must have a capacity corresponding to twice the size of the data as is the case with the image data 232.

In FIG. 29, an example of conventional driving apparatus utilizing the active driving method for the LCD is shown. The driving apparatus includes an image data buffer storage 291 for receiving and temporarily storing the image data Sv, a data convertor 600, a converted data buffer storage 295, a matrix generator 700, an LCD driver 800, and an STN-LCD 14. Note that the image data Sv corresponds to the image data 232 as described above with reference to FIG. 23, and is a matrix A of (N, M)-type in generally speaking.

The image data buffer storage 291 has two frame memories 219A and 291B each for receiving one frame of the image data Sv, and a frame selector 291 for selecting first and second frame memories 291A and 291B. The frame memory selector 291C alternately selects two frame memories 291A and 291B for each frame period to receive the image data 232 (Sv) for each row in the direction Dw, and to output for each column of the image data 232 in the direction Dr of the previous frame period, respectively, to the data convertor 600.

The data converter 600 has a column register 293 and a calculator 294. The column register 293 receives one column data of the matrix A (image data Sv) which are "N" number of data representing column vectors of the matrix A, and latches all these data.

The matrix generator 700 has an address generator 292 for generating an address data and a ROM 296. The ROM 296 stores the data representing the orthogonal matrix Z' of (N, N)-type previously. The equation (2) shows one example of the orthogonal matrix Z' when "N" is twelve. According to the address data from the address generator 292, the ROM outputs "N" number of data for one row. In other words, ROM 296 outputs the orthogonal matrix Z' to the calculator 294 and the LCD driver 800.

The calculator 294 of the data convertor 600 calculates the inner product of the row vectors generated by the ROM 296 and the column vectors latched by the column register 293. The inner products are calculated with respect to combinations of all row vectors of the matrix Z' and all column vectors of the matrix A. As a result, a multiplication of the matrix as expressed by the following equation (8) is performed.

$$bij = \sum_{k=1}^{N} hik \cdot akj \tag{8}$$

wherein "$b_{ij}$" is a data corresponding to an element on the "i"-th row and "j"-th column of the matrix B, "$h_{ik}$" is a data corresponding to an element on the i-th row and the k-th column of the matrix Z'. "$a_{kj}$" is a data corresponding to an element on the k-th row and the j-th column of the matrix A. Thus obtained converted data of matrix B is output to the converted data buffer storage 295.

The converted data buffer storage 295 has two frame memories 295A and 295B each for receiving, and frame selector 295C which are constructed in a manner similar to those of the image data buffer storage 291. The frame selector 295C alternately selects two frame memories 295A and 295B for each frame period to receive the converted data 233 for each column in the direction Dw, and to output for each row the converted data 231 in the direction Dr of the previous frame period, respectively, to the LCD driver 800.

The LCD driver 800 has a digital-to-analog (D/A) converter 8, a column driver 9, a row voltage register 12, and row driver 13. The D/A converter 9 converts the converted data 234 received from the buffer storage 295 into an analog signal. The column driver 9 applies voltages corresponding to thus converted analog signal to "M" number of column electrodes 222 of the LCD 14.

On the other hand, the row voltage register 12 latches "N" number of row vectors of the orthogonal matrix Z' output from the ROM 296, and then the row driver 13 applies voltages corresponding to the "N" number of data stored in the register 12 to "N" number of row electrodes 221 of the LCD 14. Note that both the row and column drivers 13 and 9 apply the voltage according to the data of "i"-th element of matrixes Z' and B, respectively, to the corresponding electrodes 221 and 222 at a time "i" ("i" is a natural number smaller than "N").

SUMMARY OF THE INVENTION

The object of the present invention is therefore to provide an imaging device which solves these problems.

The present invention has been developed with a view to substantially solving the above described disadvantages and has for its essential object to provide an improved driving apparatus for liquid crystal display.

In order to achieve the aforementioned objective, a driving apparatus for driving a passive matrix liquid crystal display having a liquid crystal layer capable of responding to an effective voltage between a first electrode and a second electrode provided on the opposite sides, respectively, of said liquid crystal layer based on an image data comprised of a plurality of predetermined unit data formed in the form of matrix, said apparatus comprises a first data arrangement means for storing said image data and outputting said stored image data column by column to produce a first arrangement image data having every element arranged in a first predetermined pattern; a first matrix generating means for generating a first matrix; a second matrix generating means for multiplying said first arrangement image data with said first matrix to produce a second matrix; a second data arrangement means for storing said second matrix and outputting said stored second matrix row by row to produce a second arrangement image data having every element arranged in a second predetermined pattern; and an electrode signal producing means for producing a first signal based on said first matrix to apply to said first electrode and for producing a second signal based on said second arrangement image data to apply to said second electrode.

BRIEF DESCRIPTION OF THE DRAWINGS

These and other objects and features of the present invention will become clear from the following description taken in conjunction with the preferred embodiments thereof with reference to the accompanying drawings throughout which like parts are designated by like reference numerals, and in which:

FIG. 25 is an illustration in assistance of explaining the arrangement of every element of the converted data when the orthogonal matrix enabling to display the image with a high contrast is applied;

FIG. 26 is an illustration similar to FIG. 25, but when the orthogonal matrix easy for calculation is applied;

FIG. 27 is an illustration in assistance of explaining the arrangement of every element of the converted data divided into three portions;

DETAILED DESCRIPTION OF THE PREFERRED EMBODIMENTS

Figure 1:
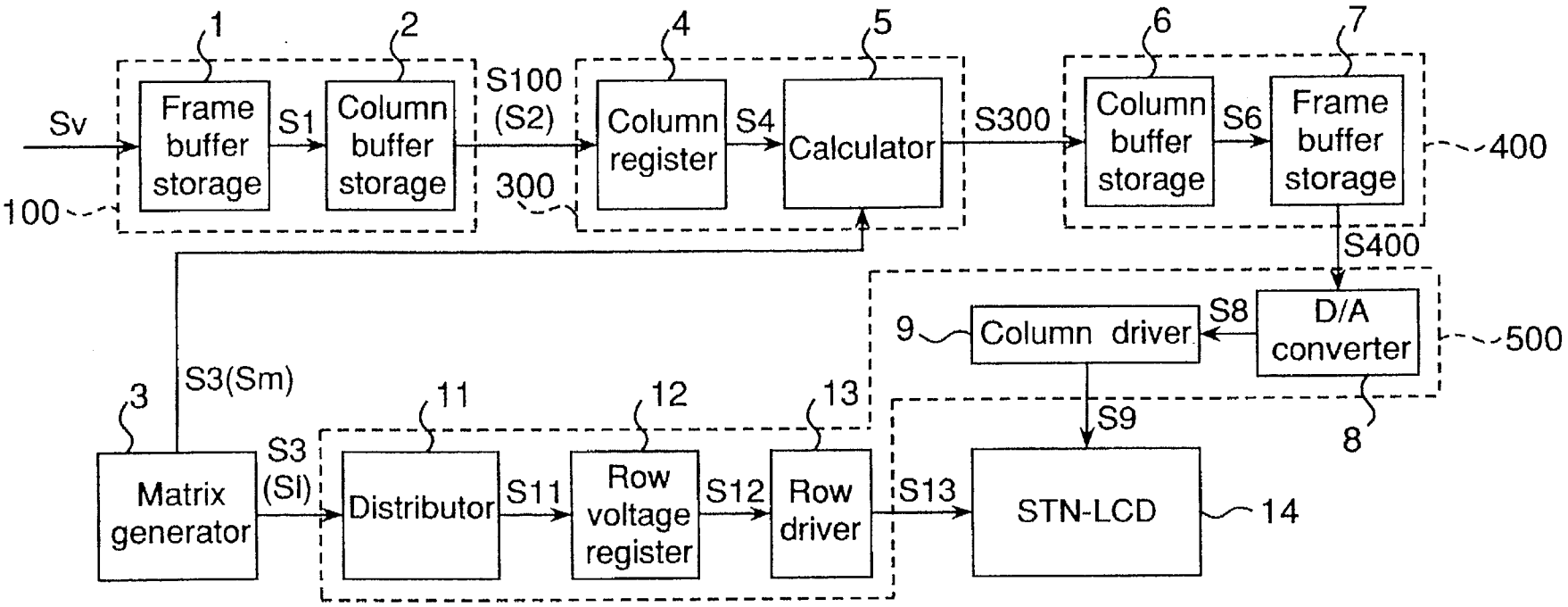
FIG. 1 is a block diagram showing a driving apparatus for a liquid crystal display according to the present invention.
Figure 23:
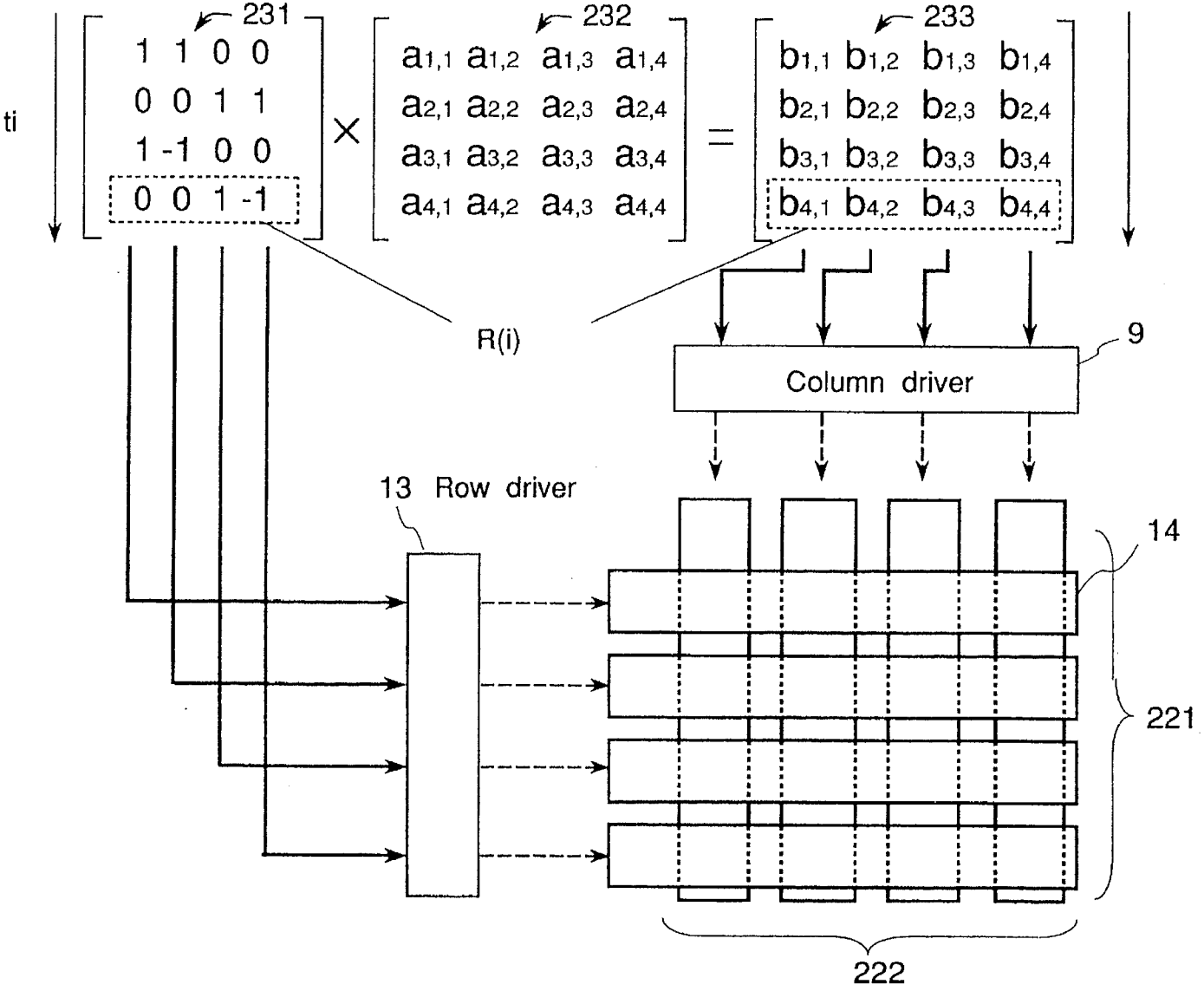
Fig.23 PRIOR ART
FIG. 23 is a graph in assistance of explaining the concept of active driving method by which plural row electrodes selected of LCD are selected during one frame period.

Referring to FIG. 1, a driving apparatus according to the present invention for driving the STN passive matrix liquid crystal display, utilizing the active driving method, to display an image based on an image signal Sv supplied from an external circuit is shown. This image signal Sv is comprised of a predetermined unit data that is a minimum requirement for data to display an image on the LCD. This predetermined unit data corresponds to one frame in this embodiment, and is in the form of matrix A of (N, M) type, as described above with reference to FIG. 23. "N" and "M" represent natural numbers. It is needless to say that the predetermined unit data may correspond to one field of the image data Sv.

The driving apparatus includes an image data buffer storage 100 for receiving and temporarily storing the image data Sv, a data convertor 300, a converted data buffer storage 400, a matrix generator 3, an LCD driver 500, and an STN-LCD that are connected to each other, as shown in FIG. 1.

Figure 24A:
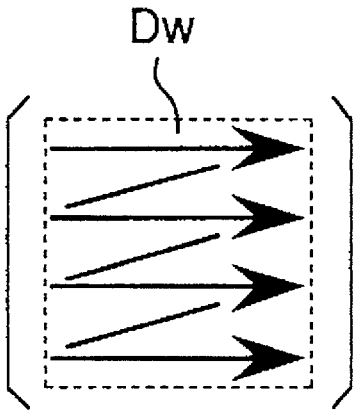
Fig.24A PRIOR ART
FIGS. 24A and 24B are illustrations in assistance of explaining the directions in Which the image in the matrix form is read therefrom and written therein according to the active driving method.

The image buffer storage 100 has a first frame buffer storage 1 for temporarily storing one frame of the image data Sv that is written therein in the direction Dw (FIG. 24A). The image buffer storage 100 further has a first column buffer storage 2 connected to the frame buffer storage 1 for reading thus stored image data in the direction Dr (FIG. 24B) from the first buffer storage 1 to outputs a rearranged image signal S100 (S2) wherein every element therein is arranged in a manner as described before.

The details of the image buffer storage 100 will be described later with reference to FIG. 2.

The matrix generator 3 generates a row vector data S3 that is "n" number of data representing row vectors of matrix x data, and is connected to the data converter 300 and LCD driver 500 for supplying the row vector data S3 thereto. The details of the matrix generator 3 will be described later with reference to FIG. 28.

The data converter 300 has a column register 4 connected to the column buffer storage 2 and a calculator 5 connected to matrix generator 3. The column register 4 receives the rearranged image data S100 for one column of the matrix A (image data Sv) which are "M" number of data representing Column vectors of matrix A, and latches all these data to produce a latched column vector data S4. The calculator 5 calculates the inner product of the row vectors S3 and the column vectors S4, as expressed by the equation (8), to produce a converted data S300. The details of column register 4 will be described later with reference to FIG. 13.

The converted data buffer storage 400 has a second column buffer storage 6 connected to the calculator 5 for temporarily storing one frame of the converted data S300 that is written therein in the direction Dw (FIG. 24A). The converted data buffer storage 400 further has a second column buffer storage 7 connected to the frame buffer storage 6 for reading thus stored converted image data S300 in the direction Dr (FIG. 24B) from the buffer storage 6 to outputs a rearranged image signal S400 (S7) wherein every element therein is arranged in a manner as described above. The details of the converted data buffer storage 400 will be described later with reference to FIG. 7.

The LCD driver 500 has a digital-to-analog (D/A) converter 8 connected to the second frame buffer storage 7 for receiving the converted data S400 therefrom and a column driver 9 connected to the D/A converter 8. The D/A converter 8 converts the converted data S400, in a digital format, into an analog signal S8. The column driver 9 applies voltages S9 corresponding to thus converted analog signal S8 to "M" number of column electrodes 222 of the LCD 14.

The LCD driver 500 further has a distributor 11 connected to the matrix generator 3 for receiving the row vectors S3, a row voltage register 12 connected to the distributor 11, and a row driver 13 connected to the row voltage register 12. The distributor 11 produce a row signal S11 based on the row vector data S3(S1) from the matrix generator 3. The row voltage register 12 latches "N" number of row vectors of the row data S11 that is the orthogonal matrix Z'. The row driver 13 applies voltages S13 corresponding to the "N" number of data stored in the register 12 to "N" number of row electrodes 221 of the LCD 14. Note that both the row and column drivers 13 and 9 apply the voltage according to the data of "i"-th element of matrixes Z' and B, respectively, to the corresponding electrodes 221 and 222 at a time "i" ("i" is a natural number smaller than "N").

Figure 2:
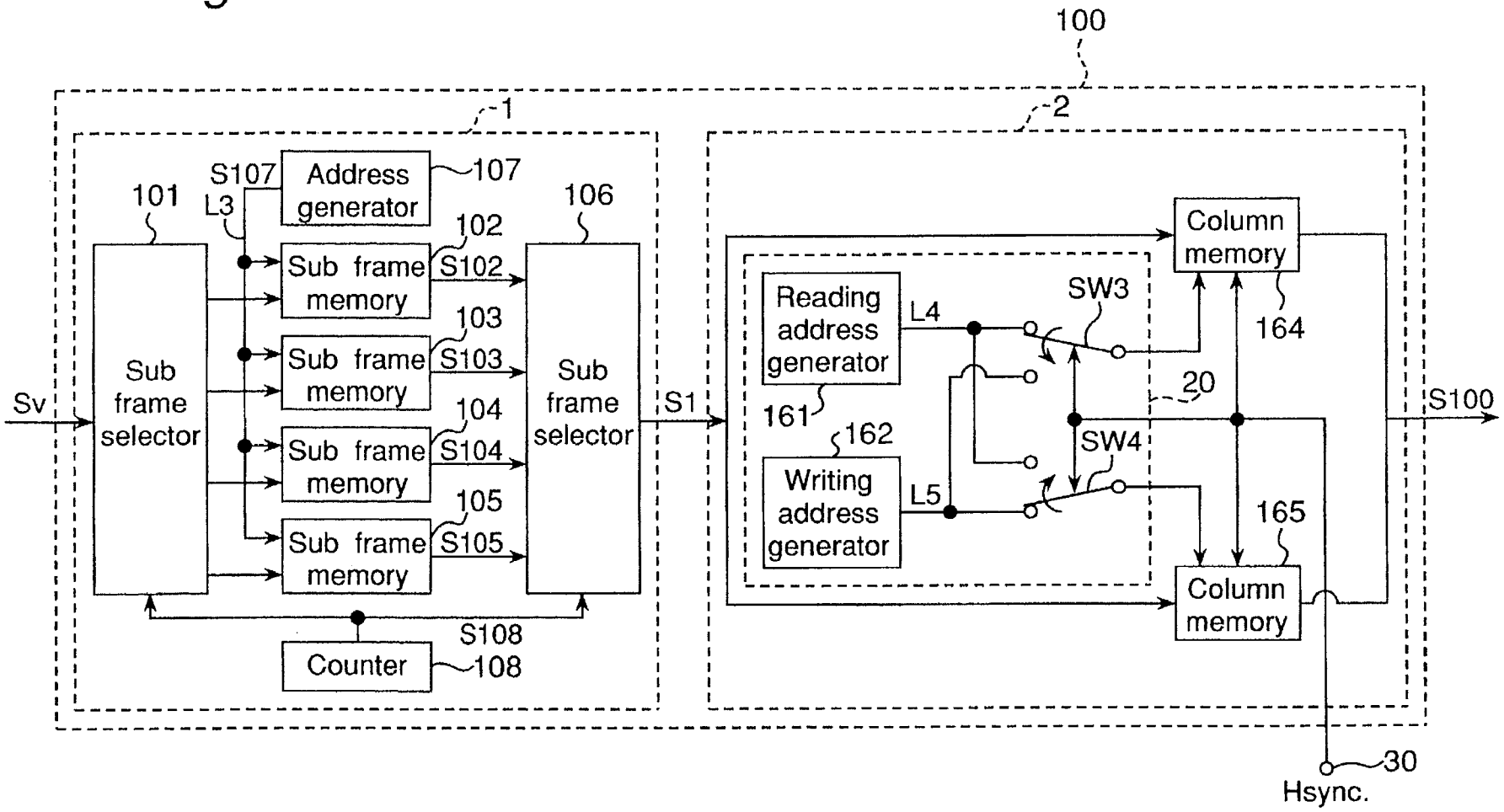
FIG. 2 is a block diagram showing the details of the image data buffer storage in the driving apparatus of FIG. 1.
Figure 3:
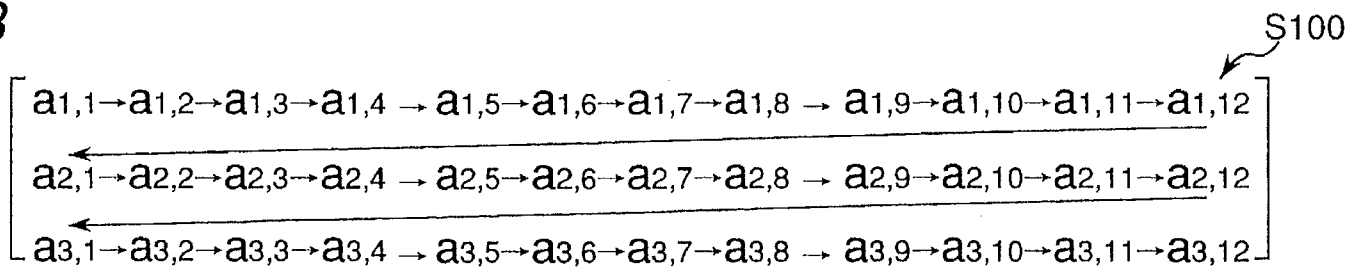
FIG. 3 is an illustration in assistance of explaining the order to transfer the image data from the image data buffer storage of FIG. 2.

Referring to FIG. 2, the image buffer storage 100 is shown. The first frame buffer storage 1 has a first sub frame selector 101 for receiving the image data Sv (one frame). A predetermined number (D), "D" is an integer and is four in this embodiment, of sub frame memories 102, 103, 104, and 105 each connected to the first sub frame selector 101 for temporarily storing the one frame of image data Sv therein. Each of sub frame memories 102, 103, 104, and 105 is comprised of a dynamic random access memory (DRAM) having a storage capacity of ¼ frame of data Sv, corresponding to 1/D of the image data Sv.

A second sub frame selector 106 is connected to each of sub frame memories 102, 103, 104, and 105, and a counter 108 connected to the sub frame selectors 101 and 106. The counter 108 repeatedly counts four numbers, corresponding to the member D of sub frame memories, in the sequence of 0, 1, 2, and 3 and transfers a counter data S108 indicative of thus counted number to the sub frame selectors 101 and 106.

An address generator 107 generates an address data S107 for each sub frame memory to alternately read and write 5 the data repeatedly in the directions Dr and Dw, respectively during one frame period. But, during next one frame period, data is read in direction Dw and is written in the direction Dr. Thus, the reading and writing directions are alternately changed between Dr and Dw every frame period. The address generator 107 is connected to each of sub frame memories 102, 103, 104, and 105 to applying the address data S107 thereto.

Based on the counter signal S108, the first sub frame selector 101 selects one of sub frame memories 102, 103, 104, and 105, and outputs the image data Sv (a portion) to the selected sub frame memory having the capacity corresponding to ¼ of one frame image data Sv. The sub frame memories 102, 103, 104, and 105 read out positions of one frame image data Sv separately stored therein at the address designated by the address data S107 and outputs sub frame data S102, S103, S104, and S105 therefrom, respectively, before writing the image data Sv at those designated address. Further based on the counter signal S108, the second sub frame selector 106 selects one of sub frame memories 102, 103, 104, and 105, and to output the sub frame data therefrom. As a result, an image data S1 corresponding to one frame of image data Sv separately stored in the sub frame memories 102, 103, 104, and 105 is output to the column buffer storage 2.

Figures 14, 15:
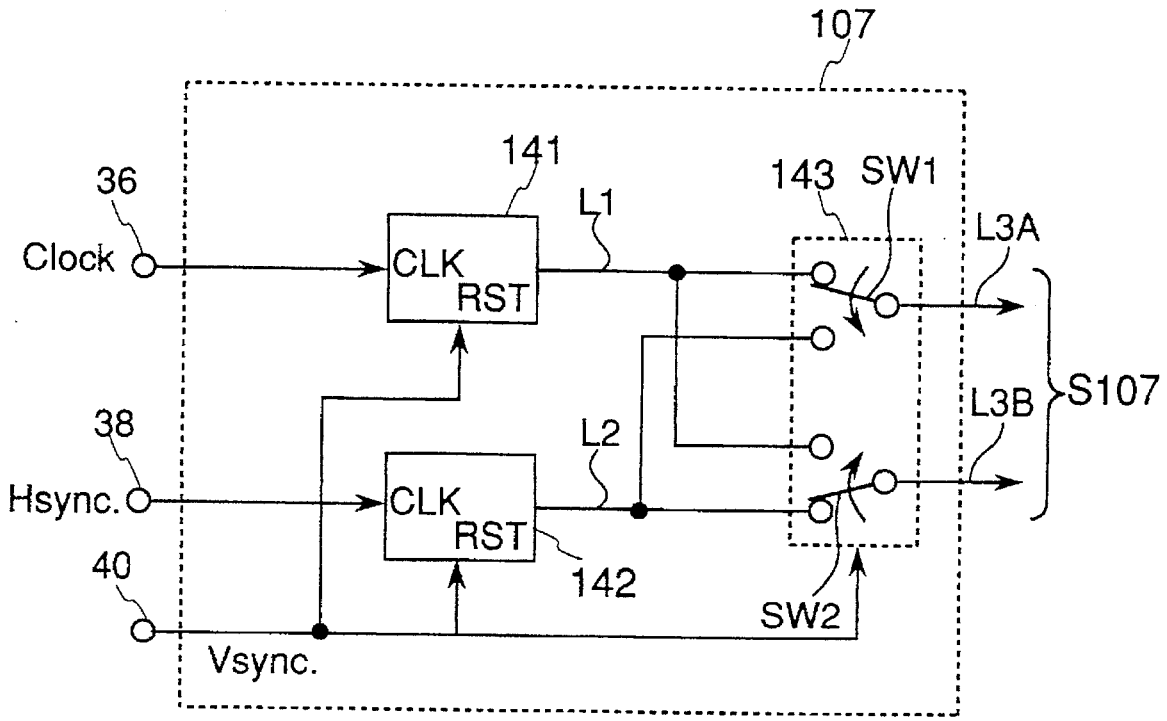
FIG. 14 is a block diagram showing the address generator used in the frame buffer storage of FIG. 2.
FIG. 15 is a graph showing an example of address inside the column memories used for the column buffer storage of FIG. 2 and for column buffer storage of FIG. 7.

Referring to FIG. 14, the detail of the address generator 107 is shown. The address generator 107 has three input terminals 36, 38, and 40, two counters 141 and 142, and a switch 143. Through the input terminals 36, 38, and 40, a clock signal Clock, a horizontal synchronization signal Hsync., and a vertical synchronization signal Vsync. are applied, respectively, to the address generator 107 from the external circuits (not shown). The first counter 141 has an input port connected to the first input terminal 36 for receiving the signal Clock therefrom, and a reset terminal connected to the third input terminal 40 for receiving the signal Vsync. therefrom and an output terminal. From the output port of counter 141, a first line L1 extends toward the switch 143. Based on the signals Clock and Hsync., the counter 141 counts a clock signal for the transfer of image data.

The second counter 142 has an input port connected to the second input terminal 38 for receiving the signal Hsync therefrom, a reset port connected to the third input terminal 40 for receiving the signal Vsync., and an output port. From the output port of counter 142, a second line L2 extends toward the switch 143. Based on the signals Hsync. and Vsync., the counter 142 Counts a clock signal for the horizontal synchronization of the image data.

The switch 143 is connected to the third input terminal 40 for receiving the signal Vsync. therefrom, and is further connected to each of sub frame memories 102, 103, 104, and 105 by a third line L3. The third line L3 is comprised of first and second sub lines L3A and L3B connected to a horizontal and vertical addressing terminals (not shown), respectively, of each of sub frame memories (DRAMs) 102, 103, 104, and 105. Based on the address data received by the horizontal addressing terminal through line L3A, the sub frame memory stores the data in the horizontal direction thereof. Based on the data received by the vertical addressing terminal through the line L3B, the sub frame memory stores the data in the vertical direction thereof.

The switch 143 has a first switching member Sw1 for selectively connecting either one of lines L1 and L2 to the lines L3A and L3B, respectively, in response to the signal Vsync, and further has a second switching member Sw2 for selectively connecting either one of lines L1 and L2 in response to the signal Vsync. Note that the first counter 141 operates faster than the second counter 142 because the clock signal for the image transfer has frequency greater than the clock signal or the horizontal synchronization signal.

Therefore, when the first and second switching members Sw1 and Sw2 are operated to connect the lines L1 and L2 to the semi lines L3A and L3B, respectively, as best shown in FIG. 14, the sub frame memories 102, 103, 104, and 105 have an access in the direction Dw shown in FIG. 24A. In other words, while the second counter 142 addresses one horizontal line (corresponding to one row), the first counter 141 can address all data included in the horizontal line designated by the second counter 142.

Figure 24B:
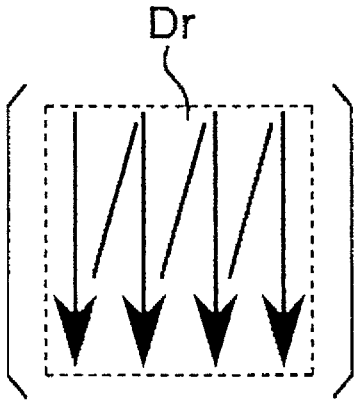
Fig.24B PRIOR ART

However, when the first and second switching members Sw1 and Sw2 are operated to connect the lines L1 and L2 to the lines L3B and L3A, respectively, the sub frame memories 102, 103, 104, and 105 have an access in the direction Dr shown in FIG. 24B. This is because that, while the second counter 142 addresses one vertical line (corresponding to one column), the first counter 141 can address all data included in the vertical line designated by the second counter 142.

With reference to FIGS. 3, 4, 5, 6A, and 6B, the data transferring operation performed in the image buffer storage 100 is described. For example, when the image data Sv is in the form of a matrix of (3, 12)-type is transferred to the frame buffer storage 1 in the sequence indicated by arrows shown in FIG. 3, all data or elements in the matrix are distributed to each element and thus distributed each element is written to the sub frame memories 102, 103, 104, and 105 one by one in the writing direction Dw of FIG. 24A successively.

Figure 4:
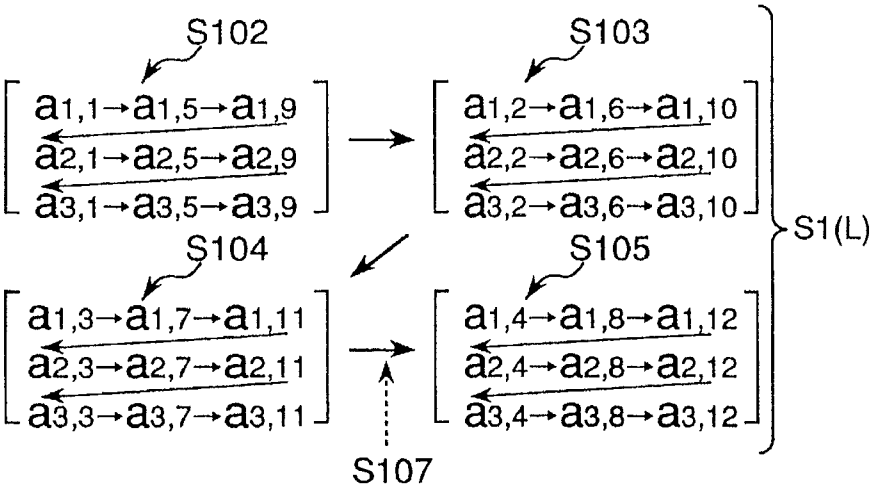
FIG. 4 is an illustration in assistance of explaining the order in which the image data buffer storage of FIG. 2 stores the image data therein and the arrangement of the stored data at a predetermined frame.

In FIG. 4, the image data Si(L) of the L-th frame separately stored in each of the sub frame memories 102, 103, 104, and 105 as data S102, S103, S104, and S104 are shown, respectively, wherein "L" is an integer. Note that the first, second, third, and fourth element $a_{1,1}$, $a_{1,2}$, $a_{1,3}$, and $a_{1,4}$ of the image data Sv is stored as the first element of the data S102, S103, S104, and S104, respectively. Generally speaking, the elements at (1+D×T)-th, (2+D×T)-th, . . . (D+D×T)-th position of the data matrix are distributed in the first, second, . . . , D-th sub frame memory, wherein "D" is number of sub frame memories, and "T" is an integer.

At the next one frame or (L+1)-th frame, each element in the data Si(L) separately stored in frame memories 102, 103, 104, and 105 are read out therefrom in the reading direction Dr (FIG. 24B). At the same time when the data stored at L-th frame is read out, the data at (L+1)-th frame is stored that address of sub frame memories.

Figure 5:
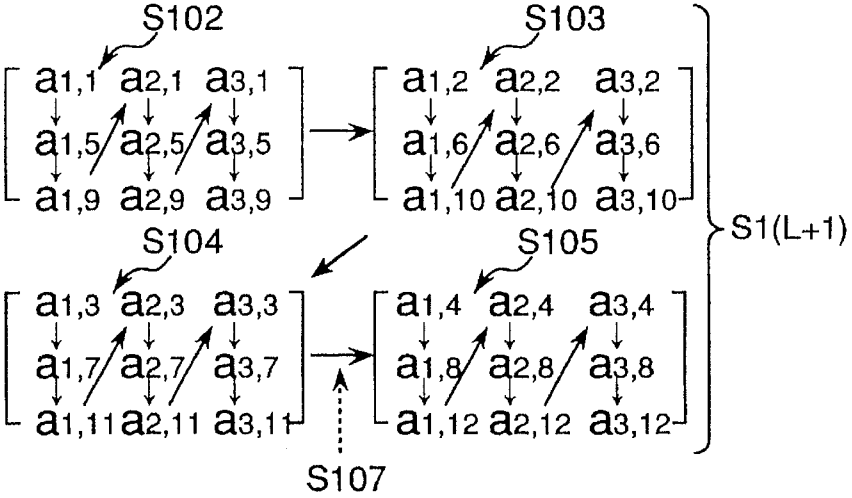
Fig.5 PRIOR ART
FIG. 5 is an illustration similar to that in FIG. 4, but at the next frame.

In FIG. 5, the image data S1 (L+1) at the (L+1)-th frame separately stored in sub frame memories 102, 103, 104, and 105 are shown. The elements in each of data S102, S103, S104, and S105 are read out in the directions indicated arrows, as shown in FIG. 5, such that after the first row data in the first column in each of data S102, S103, S104, and S105 of FIG. 4 are read out sequentially, the next row data in the first column is read out sequentially. Note that each sub frame memory alternately reads and writes the data repeatedly in the directions Dr and Dw, respectively, during one frame period. But, during next one frame period, sub frames alternately reads and writes in the directions Dw and Dr. Thus, the reading and writing directions are alternately changed between Dr and Dw every frame period.

Figure 6A:
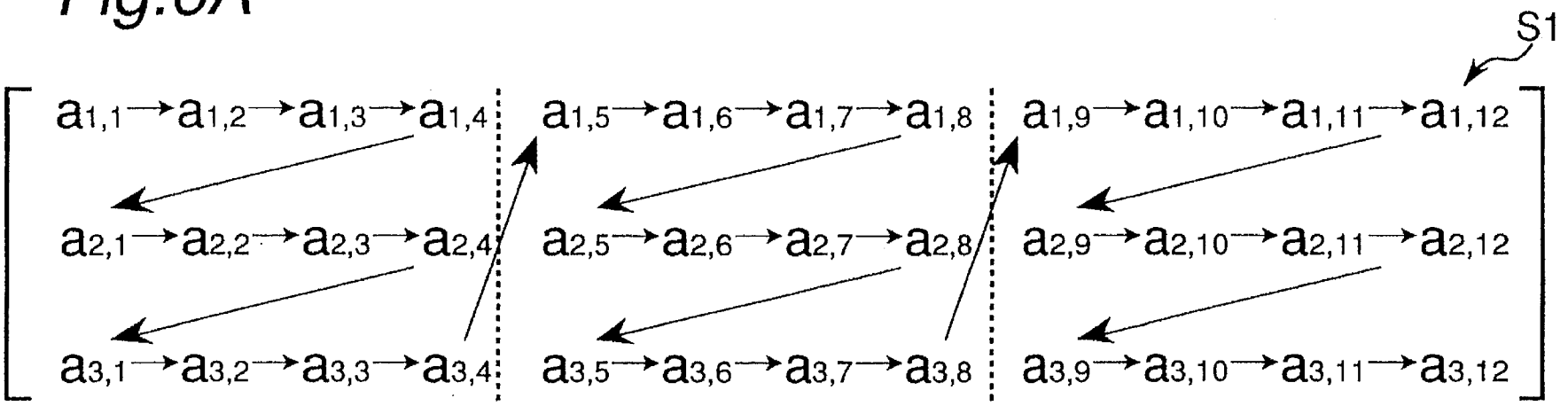
FIG. 6A is an illustration in assistance of explaining the order to write the image data from the frame buffer storage to the column buffer storage of FIG. 1.

In FIG. 6A, the image data Si(L) thus read out from the sub frame memories 102, 103, 104, and 105 of FIG. 4 at the (L+1)-th frame is shown. Since the next row data in the first column is read out sequentially after sequentially reading of the first row data in the first column in each of data S102, S103, S104, and S105 of FIG. 4, the sequence of read image data S1 from the frame buffer storage 1 is as follows.

$$a_{1,1}\rightarrow a_{1,2}\rightarrow a_{1,3}\rightarrow a_{1,4}\rightarrow a_{2,1}\rightarrow a_{2,2}\rightarrow \ldots a_{3,3}\rightarrow a_{1,2}$$

However, this sequence is trouble some for the following processing according to the driving apparatus utilizing the active driving method, as described in the above.

Figure 6B:
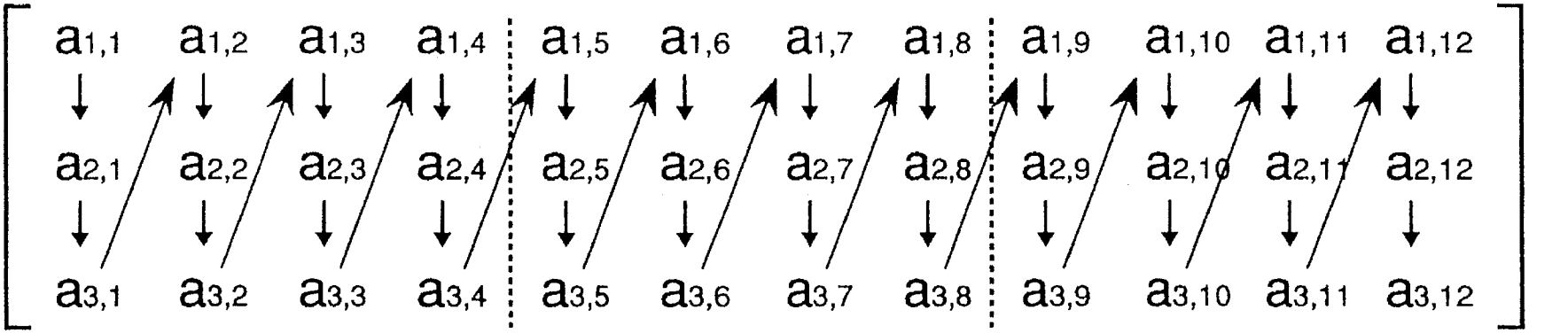
FIG. 6B is an illustration in assistance of explaining the order to read out the image data from the column buffer storage of FIG. 1.

In FIG. 6B, a sequence of elements output from the frame buffer storage 1 for the convenience of the following processing by the driving apparatus according to the present invention is shown. The data should be arranged as follows.

$$a_{1,1}\rightarrow a_{2,1}\rightarrow a_{3,1}\rightarrow a_{1,2}\rightarrow a_{2,2}\rightarrow a_{3,2}\rightarrow \ldots a_{2,12}\rightarrow a_{3,12}$$

The column buffer storage 2 temporarily stores the image data S1 (FIG. 6A) from the frame buffer storage 1 and outputs the rearranged image data S2 (FIG. 6B) wherein each element is rearranged for the convenience of the following processing.

Referring back to FIG. 2, the details of the column buffer storage 2 is shown. The column buffer storage 2 has first and second column memories 164 and 165 each connected to the second sub frame selector 106 for receiving the image data S1 therefrom. Each of column memories 164 and 165 is comprised of a high speed accessible memories such as a static random access memory (SRAM). Each of column memories 164 and 165 has a storage capacity corresponding to several columns of data S1, and has a very high access speed such that each of column memory 164 and 165 can read and write the entire image data S1 during one frame period by repeatedly reading and writing several columns of the data S1 so frequently. In other words, the column buffer storage 2 can store and output the data corresponding to twice the image data S1 for one frame. In total, a half frame period is used for writing the data S1, and another half frame period is used for reading out.

The column buffer storage 2 further has an input terminals 30, a reading address generator 161, and a writing address generator 162, and third and fourth switching members Sw3 and Sw4. Through the input terminal 30, the horizontal synchronization signal Hsync. is applied to the column memories 164 and 165 and switching members Sw3 and Sw4 from the external circuits (not shown). In response to the signal Hsync. the column memories 164 and 165 alternately write the data S1 therein or read out the data S1 therefrom.

The reading address generator 161 generates and outputs a reading address data through a line L4 extending therefrom. The writing address generator 162 generates and outputs a writing address data through a line L5 extending therefrom.

The third and fourth switching members Sw3 and Sw4 are operated to selectively connecting either one of lines L4 and L5 to the column memories 164 and 165, respectively, in response to the signal Hsync, so that the reading address data. Ar and writing address data Aw supplied to whichever the column memories 164 and 165 is in reading operation and in the writing operation, respectively. Based on the reading address data and writing address data, the column memories 164 and 165 read out and the write the image data S100 in the sequence described above with reference to FIGS. 6A and 6B. Note that the switching member Sw3 and Sw4 and address generators 161 and 162 enclosed by a dot line construct a column memory selector 20 which alternately selects two column memories 164 and 165 for a period corresponding to several columns to receive the image data S1 each row in the direction Dw, and to output for each column the image data of the previous frame period in the direction Dr, respectively. In total, each of column memories 164 and 164 stores the data S1 therein for a 5 half frame period, and reads out thus data (S100) therefrom for the rested half frame period.

Referring to FIG. 15, an example of address inside column memories 164 and 165 is shown. Specifically, the address is designated by each of sixteen number (4-bit) from 0 to 15, but no address corresponding to numbers of "3", "7", "11", and "15" is available in both the column memories 164 and 165 actually. Therefore, even when any of these address numbers is designated, both the column memories 164 and 165 quit their operation.

Figure 16:
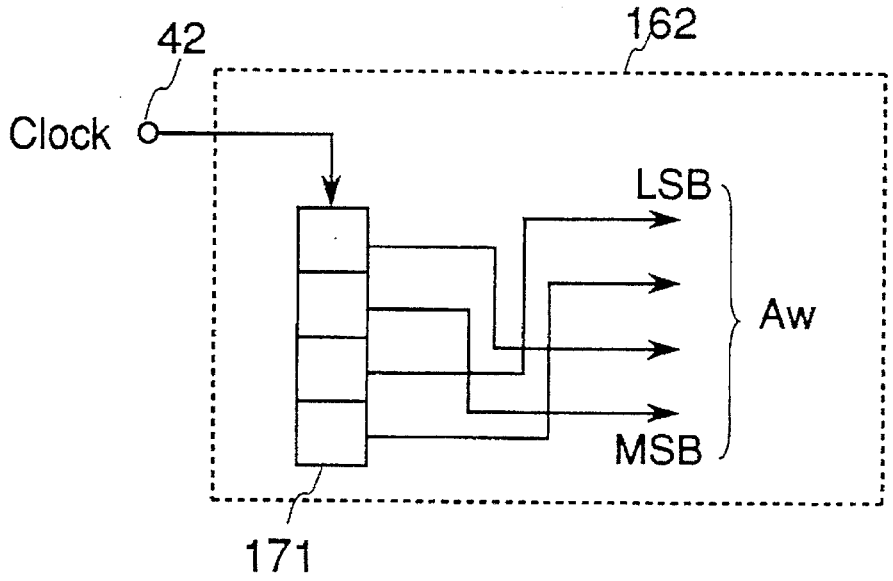
FIG. 16 is a block diagram showing the writing address generator used in the column buffer storage of FIG. 2.

Referring to FIG. 16, the details of writing address generator 162 is shown. The writing address generator 162 has a first 4-bit counter 171 counting sixteen numbers from 0 to 15 in the ascending order. However, output lines of writing address generator 162 are twisted, as shown, to exchange lower bits and upper bits. As a result of this twist, writing address generator 162 repeatedly outputs the sixteen numbers as a writing address data Aw in the following sequence.

$$0\rightarrow 4\rightarrow 8\rightarrow 12\rightarrow 1\rightarrow 5\rightarrow 9\rightarrow 13\rightarrow 2\rightarrow 6\rightarrow 10\rightarrow 14\rightarrow 3\rightarrow 7\rightarrow 11\rightarrow 15$$

In response to the writing address data Aw output in this twisted sequence, either one of column memories 164 and 165 writes the image data S1 therein in the sequence of FIG. 6A.

Figure 17:
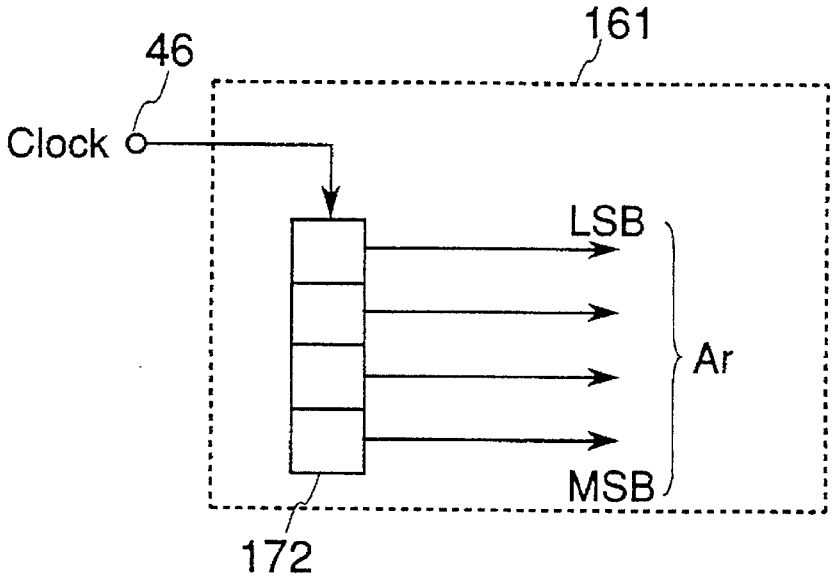
FIG. 17 is a block diagram showing the reading address generator used in the column buffer storage of FIG. 2.

Referring to FIG. 17, the details of reading address generator 161 is shown. The reading address generator 161 has a second 4-bit counter 172 identical to the first counter 171, but the output lines thereof are not twisted so as to outputs the sixteen numbers as the reading address data Ar in the ascending order, as follows.

0→1→2→3→4→5→6→7→8→9→10→11→12→13→14→15

In response to the reading address data Ar in the ascending order, either one of column memories 164 and 165 reads out the image data S1 therefrom in the sequence of FIG. 6B, resulting in the rearranged image signal S2 (S100). This rearranged image signal S2 (S100) is further transferred to the data converter 300 from the frame buffer storage 1.

As apparent from the above descriptions, the frame buffer storage 1 can write in and read out the image data Sv in a speed "D" times faster than that when the fast mode of DRAM is not effective, can be comprised memories having the storage capacity for a full image which will be displayed by the LCD at a time. Although one frame is used as this full image in this embodiment, but any other units for image data such as field are also effective. The column buffer storage 2 can receives the image data S1 for "D" number of columns from the frame buffer storage 1 and outputs the rearranged image data S100 wherein all elements are arranged in the correct order with respect to the active driving method.

With reference to FIGS. 1, 26, and 27, the operations of the matrix generator 3, the column register 4, and the calculator 5 are briefly described. Since the orthogonal matrix X is repeatedly generated during the one frame period by the Sow vector S3 which is output from the matrix generator 3 for the calculation purpose. For example, the orthogonal matrixes 55, 58, and 61 shown in FIG. 27 are generated during the one frame period. The column register 4 divides the image data transferred thereto into a predetermined number of portions. The calculator 5 calculates each of divided image data portions and the data S3 from the matrix generator 3, so that multiplications of three matrixes are executed, as shown in FIG. 27. As a result, the calculation shown in FIG. 26 is made by the matrix generator 3 and calculator 5.

Figure 13:
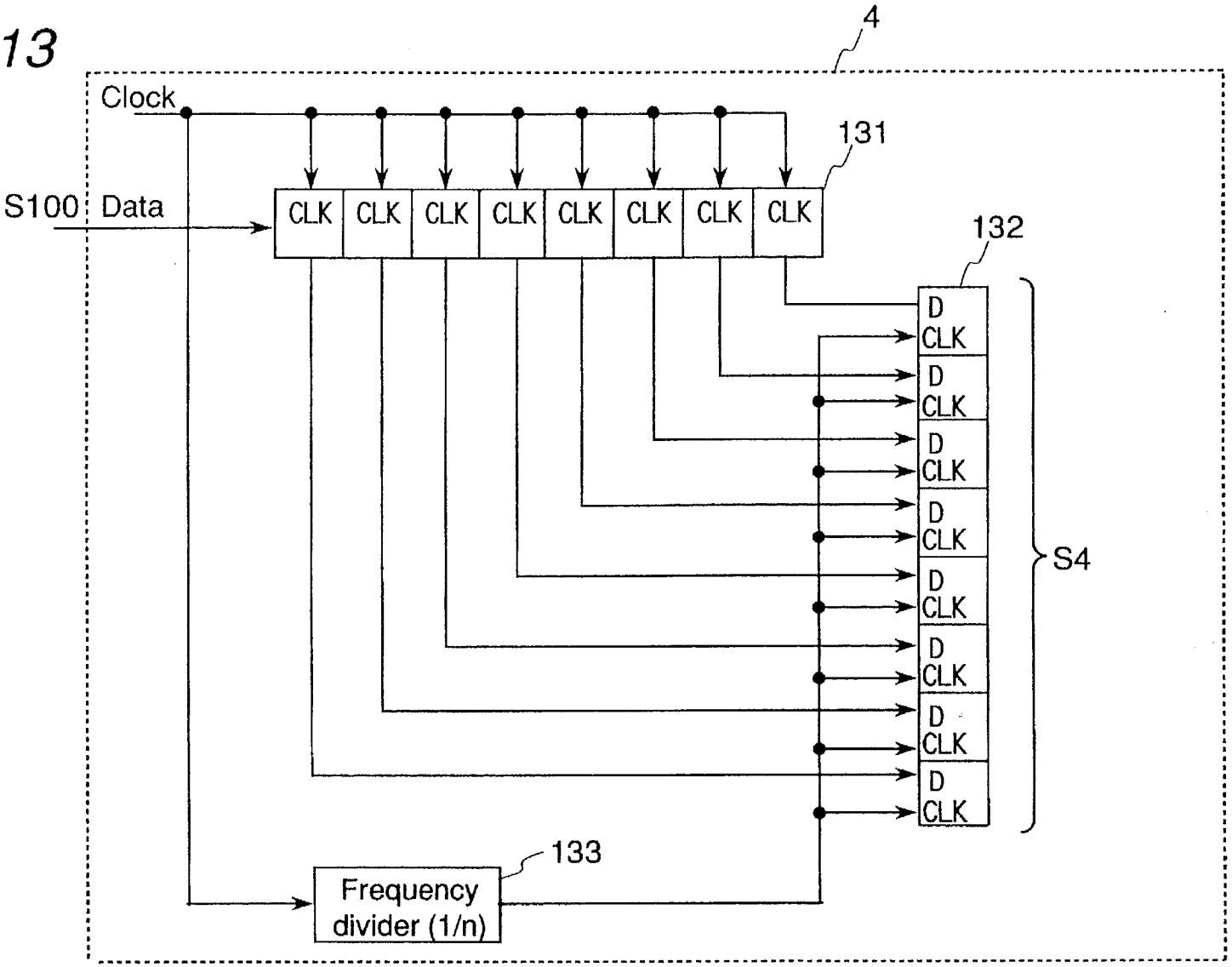
FIG. 13 is a block diagram showing the column register of FIG. 1.

Referring to FIG. 13, the details of column register 4 is shown. The column register 4 has a n-step shift register 131, a latch circuit 132, and a frequency divider 133 which are connected to each other, as shown. The clock signal Clock is applied to the n-step shift register 131 and the frequency divider 133. The n-step shift register 131 is connected to the column buffer storage 2 for receiving the rearranged image data S2 (S100) therefrom in a serial order. The frequency divider 133 divides the frequency of signal Clock into 1/n thereof, and produces a latch pulse to the latch circuit 132 when "n" number of elements of image data S100 are stored by the n-step shift register 131. Then, the column register 4 successively transfers every "n" number of the "N" number of data forming the column vector of image data in parallel as a column vector data S4 therefrom.

Although the data converter 300 performs the calculation shown in FIG. 26, it is the matrixes such as the matrix Z' expressed by the equation (2) or the orthogonal matrix 50 shown in FIG. 25 that are used as the vector signal. Therefore, the sequence of columns in the data S300 output from the calculator 5 varies as specifically recognized by comparing the column sequence in the converted data 52 in FIG. 25 with the converted data 54 in FIG. 26.

Figure 8A:
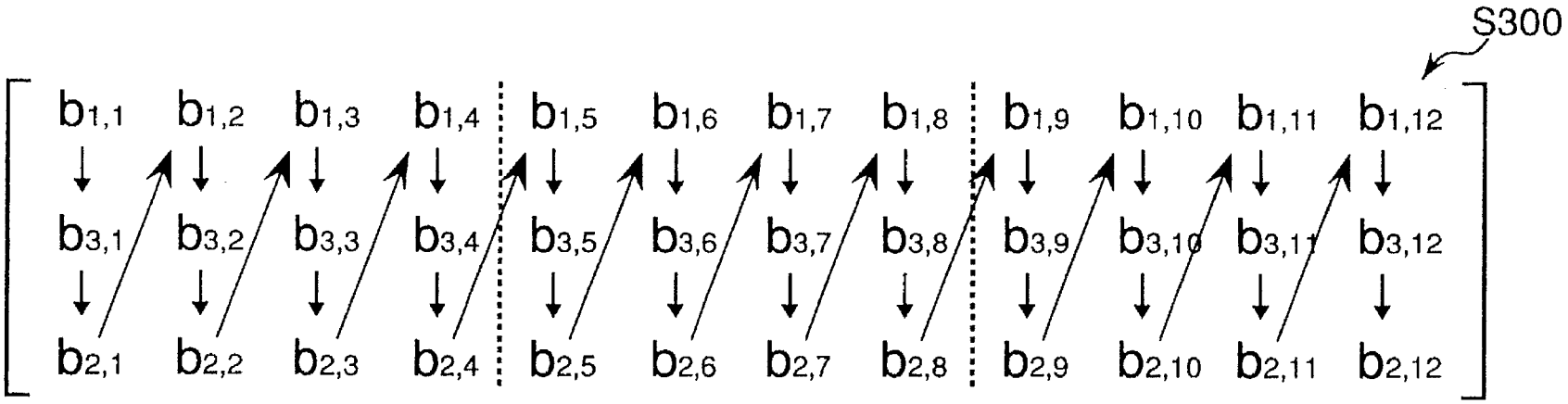
FIG. 8A is an illustration in assistance of explaining the order to write the image data from the data converter to the column buffer storage of FIG. 1.
Figure 8B:
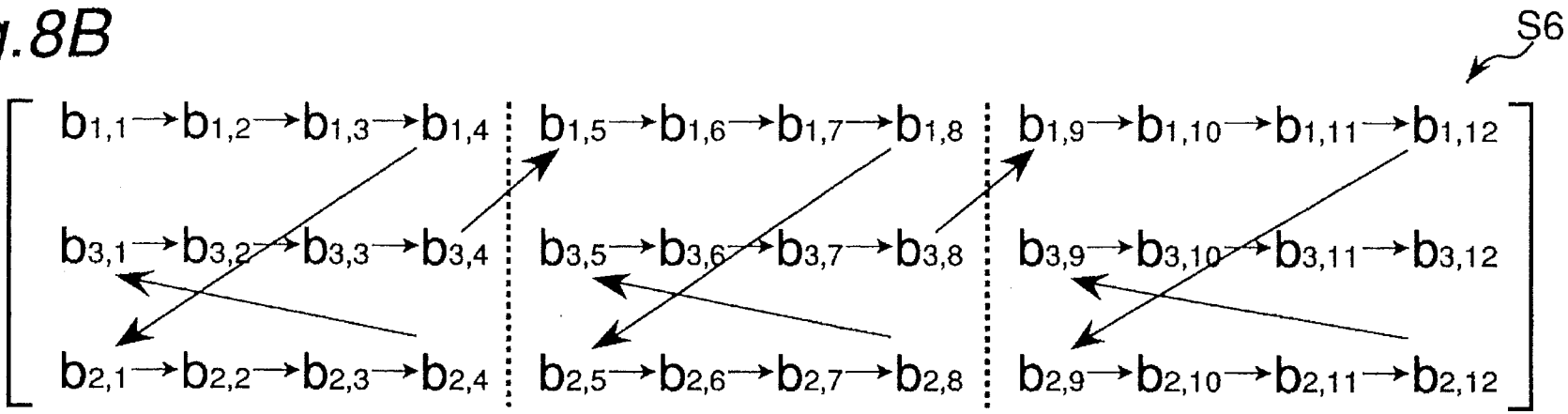
FIG. 8B is an illustration in assistance of explaining the order to read out the image data from the second column buffer storage of FIG. 1.

To solve this problem, the column buffer storage 6 of the converted data buffer storage 400 temporarily stores the rearranged image data S300 for "D (four) " number of columns in an incorrect order, as shown in FIG. 8A, further rearranged each element in a correct order, as shown in FIG. 8B, and then outputs thus further rearranged data S6 to frame buffer storage 7. This rearrangement of data is performed utilizing parameters "i" and "i" expressed by the equations (6) and (7), respectively, because the converted data 52 (FIG. 25) is obtained by replacing the i-th row with i'-th row of the matrix 54 (FIG. 26) when the orthogonal matrix 50 (FIG. 25) is obtained by replacing the i-th row with i'-th row of the matrix 53 (FIG. 26).

Figure 7:
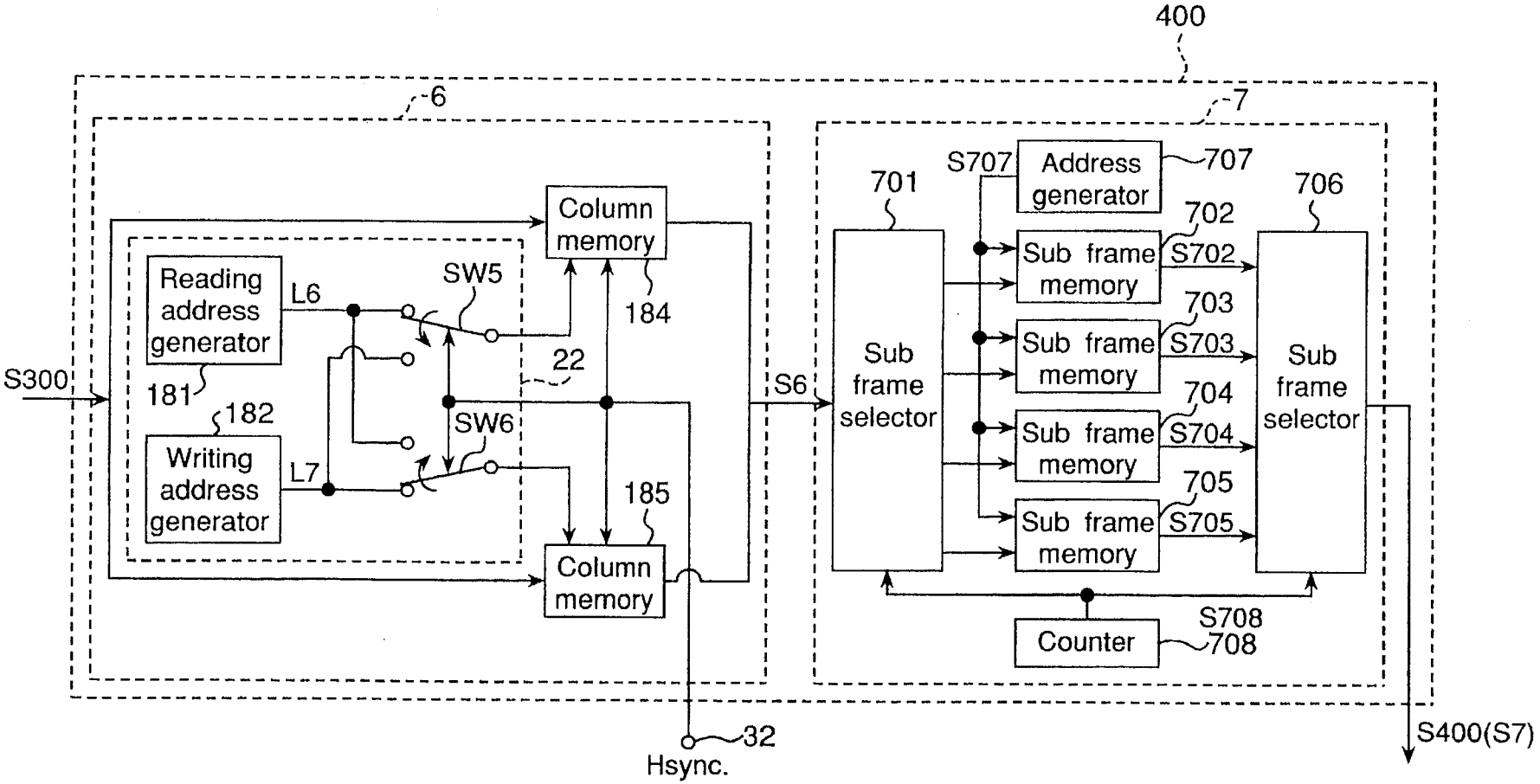
FIG. 7 is a block diagram showing the details of the converted data buffer storage in the driving apparatus of FIG. 1.

Referring to FIG. 7, the details of converted data buffer storage 400 is shown. The second column buffer storage 6 and the second frame buffer storage 7 have constructions substantially the same as those of the first column buffer storage 2 and the first frame buffer storage 1, respectively, specifically shown in FIG. 2. A column memory selector 22 enclosed by a dot line alternately selects two column memories 184 and 185 for a period corresponding to several columns to receive each data of the column of the image data S1 in the direction Dw as a row data, and to output each data of the row in the direction Dr as a column data of the image data of the previous frame period, respectively, as follows.

In the second column buffer storage 6, a third and fourth column memories 184 and 185 are connected to the calculator 5 for receiving the rearranged image data S300 therefrom. In response to the horizontal synchronization signal Hsync., applied through an input terminals 32, column memories 184 and 185 alternately writes the data S300 therein or read out S300 therefrom; and fourth and fifth switching members Sw5 and Sw6 are operated to selectively connecting either one of lines L6 and L7 to the column memories 184 and 185, respectively, so that the reading address data Ar generated by a second reading address generator 181 and the writing address data Aw generated by a second writing address generator 182 are supplied to whichever the column memories 184 and 185 is in reading operation and in the writing operation, respectively. Thus, the column memories 184 and 185 read out and write in an image data S6 in the sequence which will be described with reference to FIGS. 8A and 8B.

Figure 18:
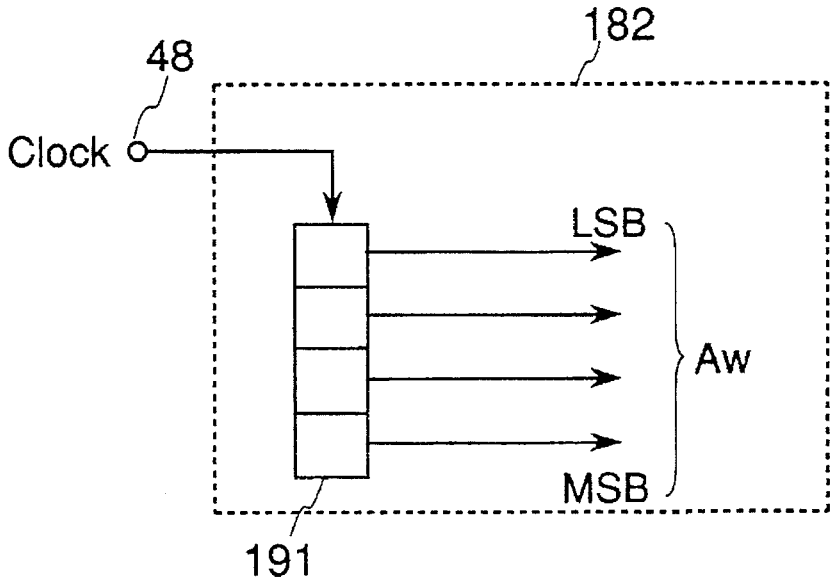
FIG. 18 is a block diagram showing the writing address generator used in the column buffer storage of FIG. 7.

Referring to FIG. 18, details of writing address generator 182 is shown. The second writing address generator 182 has a construction substantially the same as that of first reading address generator 161 shown in FIG. 17. As a result, in response to the clock signal through an input terminal 48, a third 4-bit counter 191 outputs the sixteen numbers as the writing address data Aw in the ascending order, as follows.

0→1→2→3→4→5→6→7→8→9→10→11→12→13→14→15

In response to the writing address data Aw in the ascending order, either one of column memories 184 and 185 writes the image data S300 in the sequence of FIG. 8A, resulting in the rearranged image signal S6. This rearranged image signal S6 is further transferred to the second frame buffer storage 7.

Figure 19:
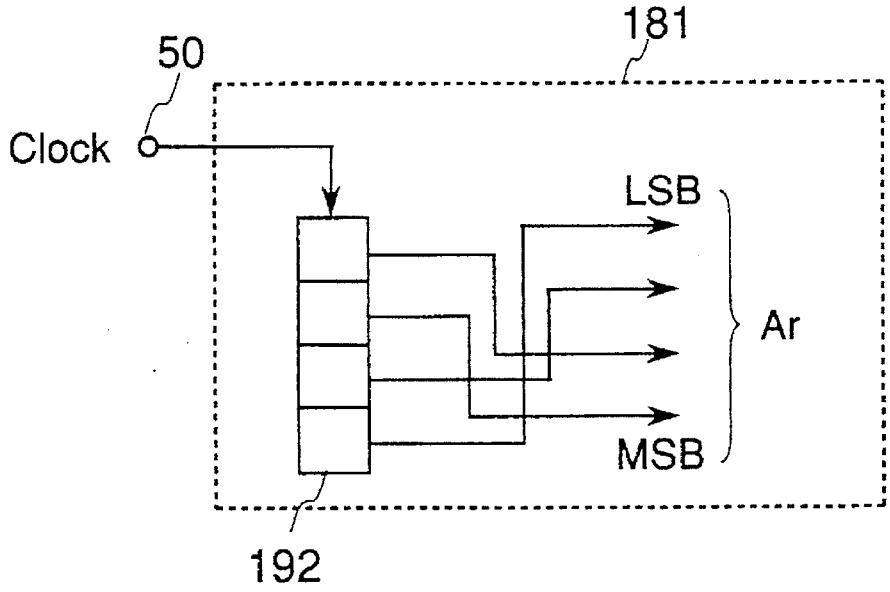
FIG. 19 is a block diagram showing the reading address generator used in the column buffer storage of FIG. 7.

Referring to FIG. 19, details of reading address generator 181 is shown. The second reading address generator 181 has a construction substantially the same as that of first writing address generator 162 shown in FIG. 16. As a result, in response to the clock signal through an input terminal 50, a fourth 4-bit counter 192 outputs the sixteen numbers as the reading address data Ar in the following sequence.

0→4→8→12→1→5→9→13→2→6→10→14→3→7→11→15

In response to the writing address data output in this twisted sequence, either one of column memories 184 and 185 read outs the image data S300 therefrom in the sequence of FIG. 8B.

Referring back to FIG. 7, the details of the second frame buffer storage 7 is shown. The frame buffer storage 7 has a construction substantially the same as that of the first frame buffer storage 1 shown in FIG. 2. Therefore, based on the counter signal S708 generated by a counter 708, a third sub frame selector 701 selects one of sub frame memories 702, 703, 704, and 705, and outputs the image data S6 (a portion) to the selected sub frame memory having the capacity corresponding to 1/D (D is four in this embodiment) of one frame image data S6.

The sub frame memories 702, 703, 704, and 705 read out portions of one frame image data S6 separately stored therein at the address designated by an address data S707 generated by an address generator 707 and outputs sub frame data S702, S703, S704, and S705 therefrom, respectively, before writing the image data S6 at those designated address. Further based on the counter signal S708, a fourth sub frame selector 706 selects one of sub frame memories 702, 703, 704, and 705, and to output the sub frame data therefrom.

As a result, a image data S400 (S7) corresponding to one frame of image data Sv separately stored in the sub frame memories 702, 703, 704, and 705 is output to the D/A converter 8. Note that the address generator 707 also has a construction substantially the same as that of address generator 107 of FIG. 14.

With reference to FIGS. 8A, 8B, 9, 10, and 11, the data transferring operation performed in the converted data buffer storage 400 is described. For example, when the converted data S300 in the form of a matrix of (3, 12)-type is transferred to the converted data buffer storage 400 in the sequence indicated by arrows shown in FIG. 8A, all data or elements in the matrix are distributed to each element. Thus distributed each element is written to the sub frame memories 702, 703, 704, and 705 one by one in the direction Dr of FIG. 24B successively.

Figure 9:
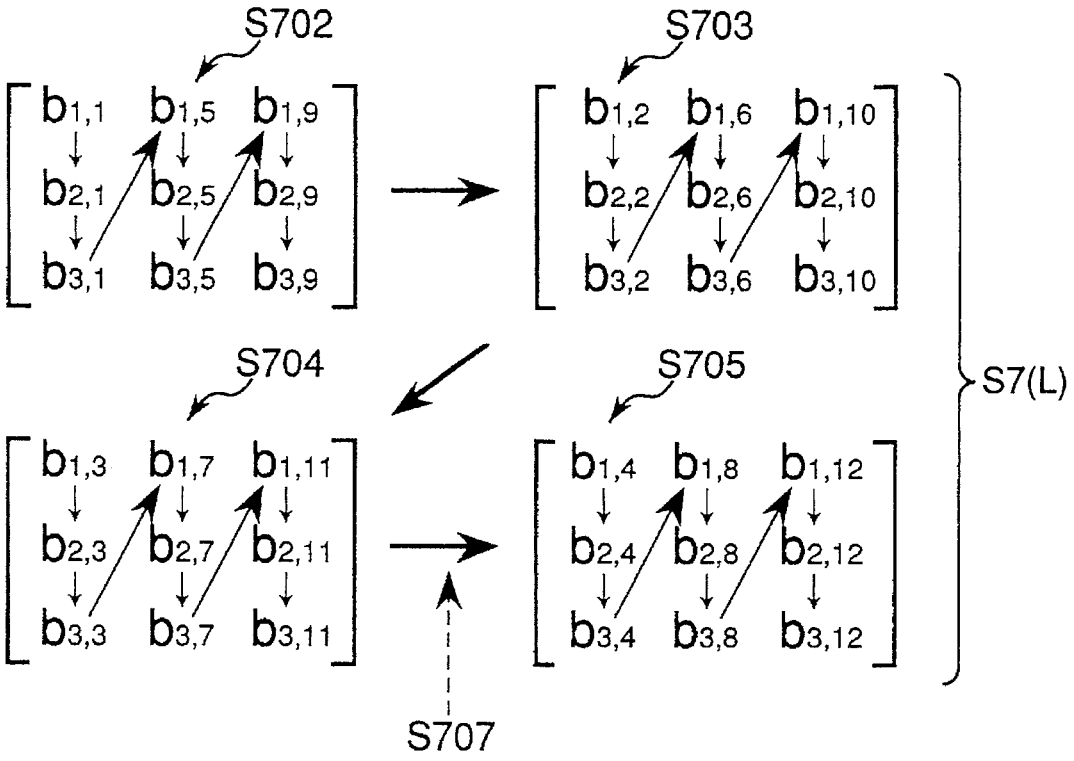
FIG. 9 is an illustration in assistance of explaining the order in which the frame buffer storage of FIG. 7 stores the image data therein and the arrangement of the stored data at a predetermined frame.

In FIG. 9, the converted data S6(L) of the L-th frame separately stored in each of sub frame memories 702, 703, 704, and 705 as data S702, S703, S704, and S704 are shown, respectively. Note that the first, second, third, and fourth element $b_{1,1}$, $b_{1,2}$, $b_{1,3}$, and $b_{1,4}$ of the converted data S6 shown in FIG. 8A are stored as the first element of the data S702, S703, S704, and S704, respectively.

At the next one frame or (L+1)-th frame, each element in the data S6(L) separately stored in frame memories 702, 703, 704, and 705 are read out therefrom in the reading direction Dw (FIG. 24A). At the same time when the data stored at L-th frame is read out from the address, new data at (L+1)-th frame corresponding to thus read out data is stored to that address of sub frame memories.

Figure 10:
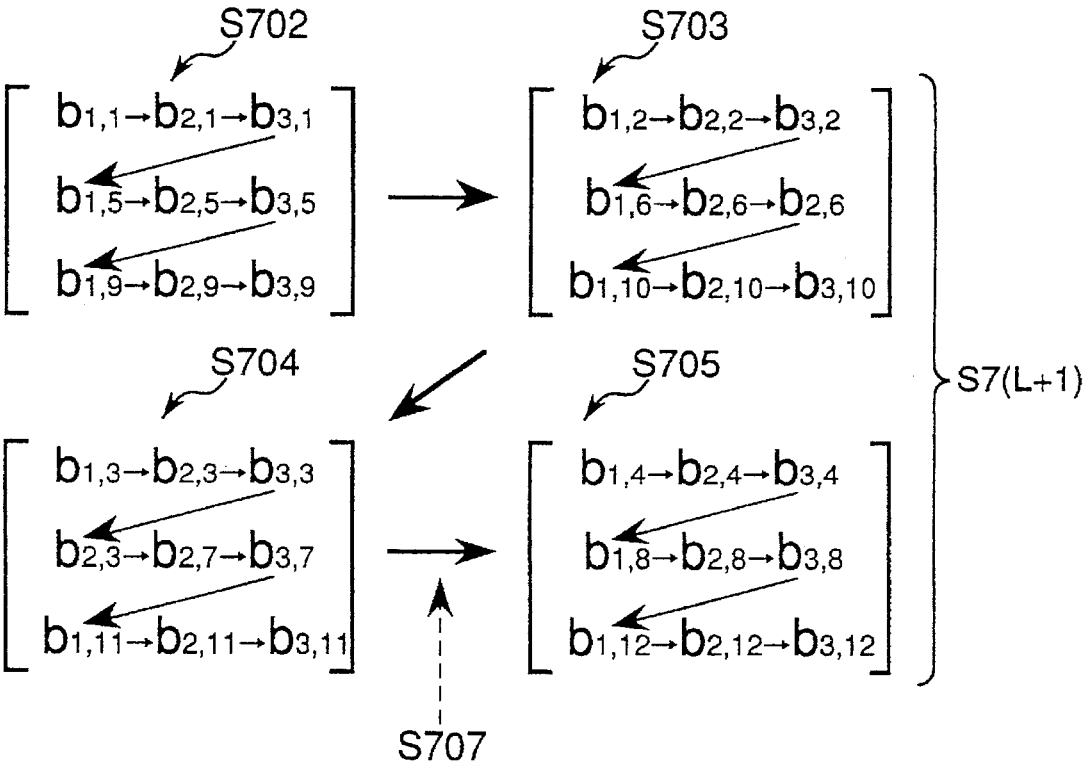
FIG. 10 is an illustration similar to that in FIG. 9, but at the next frame.
Figure 11:
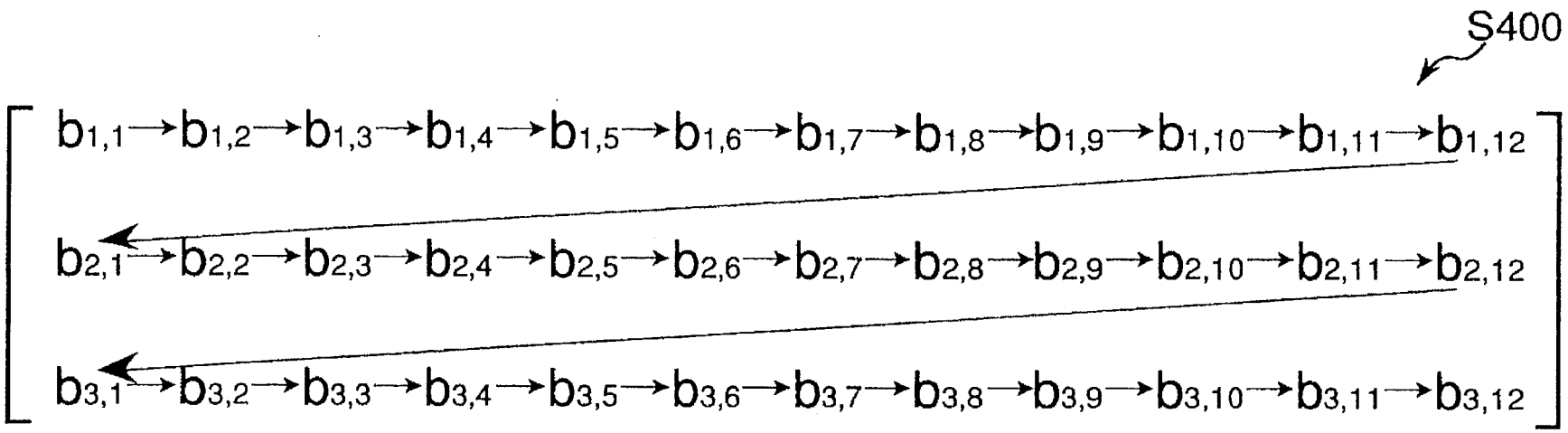
FIG. 11 is an illustration in assistance of explaining the order in which the converted data buffer storage transfer the image data therefrom.

In FIG. 10, the converted image data S6 (L+1) at the (L+1)-th frame separately stored in sub frame memories 702, 703, 704, and 705 of FIG. 9 is shown. The elements in each of data S702, S703, S704, and S705 of FIG. 9 are read out in the directions indicated arrows shown in FIG. 10, such that after the first row data in the first column in each of data S702, S703, S704, and S705 of FIG. 10 are read out sequentially, the next row data in the first column is read out sequentially. As a result, the matrix as shown in FIG. 11 is obtained.

As apparent from the above descriptions, the frame buffer storage 7 can write in and read out the converted image data S300 in a speed "D(four in this times)" or more times faster than that when the fast mode of DRAM is not effective, can be comprised memories having the storage capacity for the converted image data S300. The column buffer storage 6 can receives the converted image data S300 for "D" number of columns output from the calculator 5 and outputs the rearranged image data S6 wherein all elements are arranged in the correct order with respect to the active driving method. Note that the rearranged image data S6 is the data sequentially output from the column of converted data 52 which is converted with respect to the matrix Z' expressed by the equation (2) and the orthogonal matrix 50.

Figure 28:
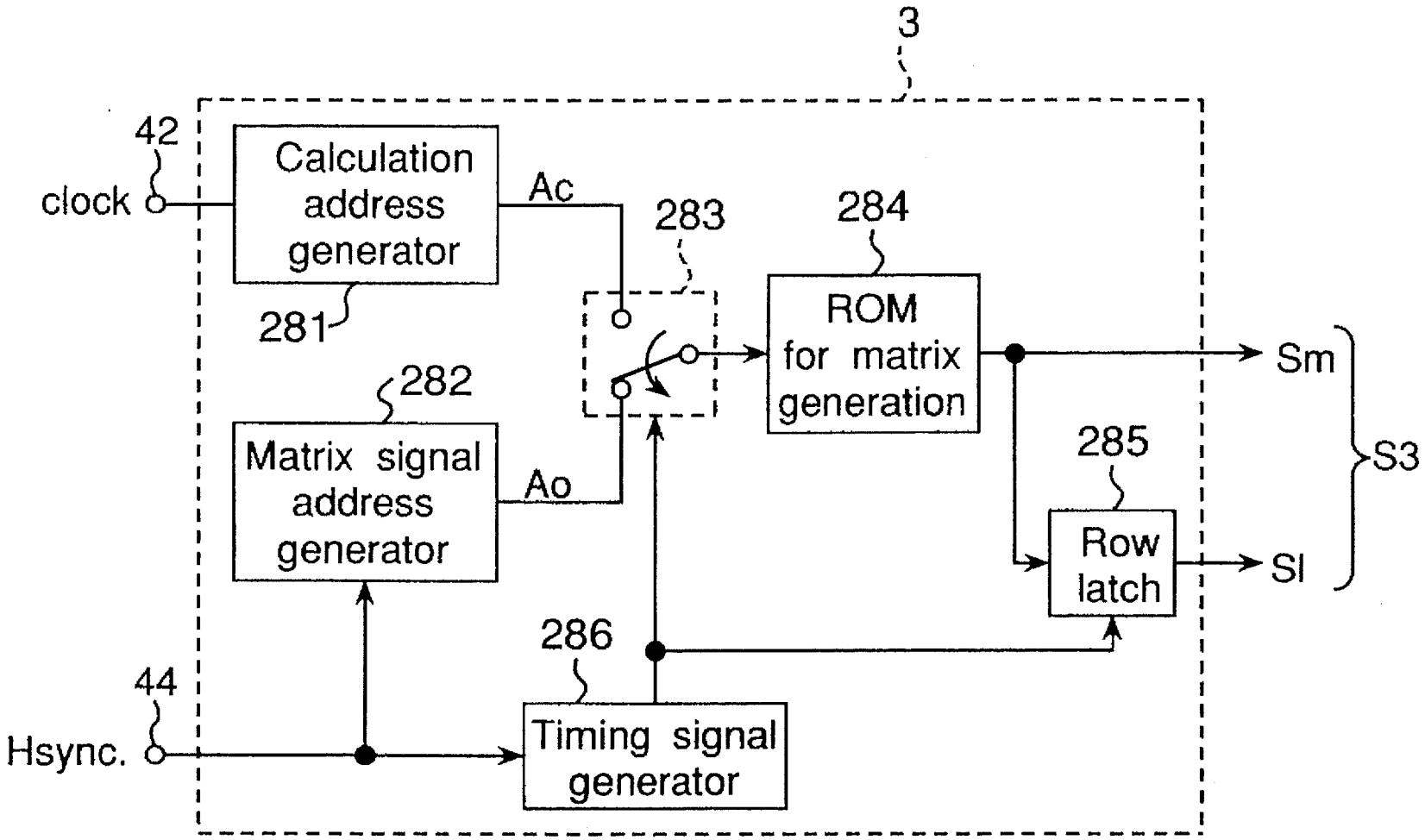
FIG. 28 is a block diagram showing the matrix generator of FIG. 1.
Figure 29:
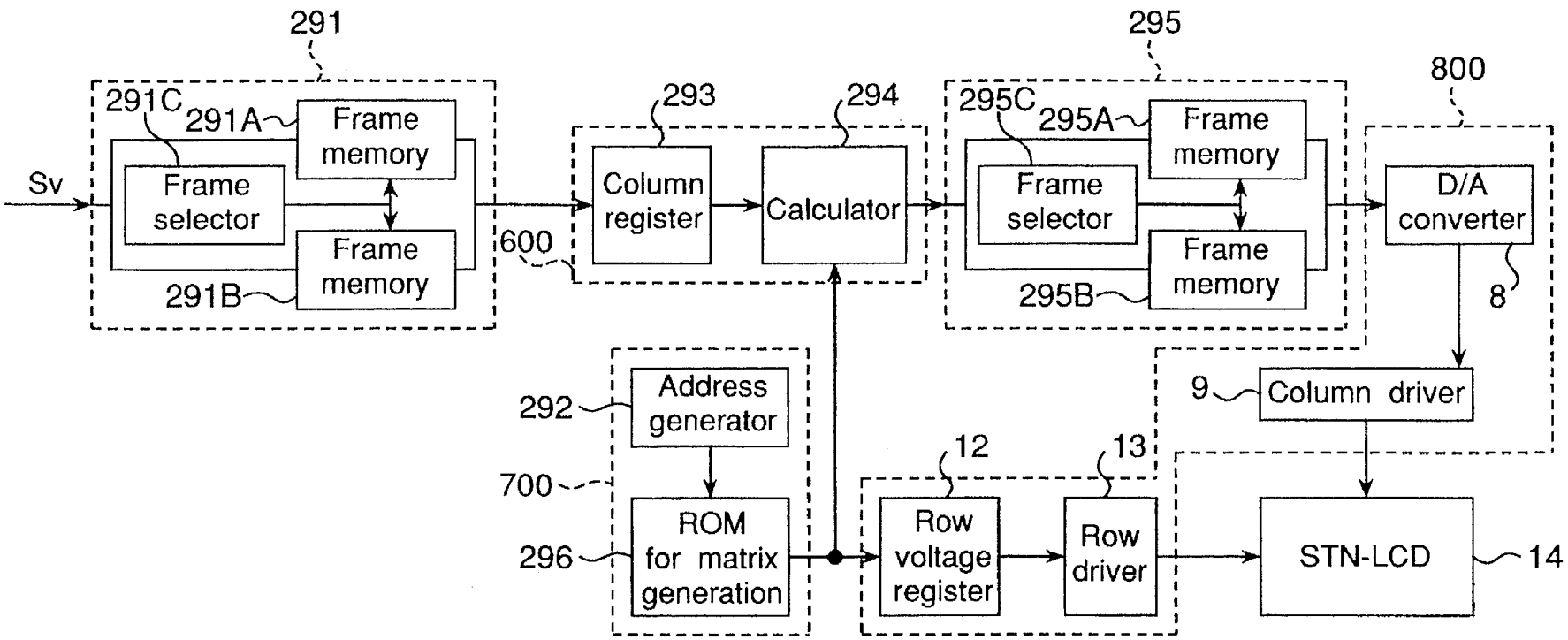
Fig.29 PRIOR ART
FIG. 29 is a block diagram showing a conventional driving apparatus for a liquid crystal display.

Referring to FIG. 28, the details of the matrix generator 3 is shown. The matrix generator 3 has an input terminal 42 for receiving the signal Clock from the external circuits (not shown). A calculation address generator 281 is connected to the input terminal 42 to count the clock signal for the transfer of image data, as the counter 141 (FIG. 14) of address generator 107 for the frame buffer storage 1 (FIG. 2) does, and output thus counted number data Ac therefrom.

Another input terminal 44 is provided for receiving the horizontal synchronization signal Hsync. applied from the external circuits (not shown). A row signal address generator 282 and a timing signal generator 286 are both connected to the input terminal 44. The row signal address generator 282 counts once per "m (=N/n)" number of the signal Hsync. and outputs thus counted number data Ao therefrom. The timing signal generator 286 outputs one pulse every "m" number of signal Hsync.

A switching member 283 is connected to a ROM for matrix generation 284 and the timing signal generator 286. In response to the timing pulse from the timing signal generator 286, the switching member 283 is selectively operated to connect either one of address generators 281 and 282 to the ROM 284 to selectively apply the counted number data Ac and Ao to the ROM 284. Specifically, only when receiving the timing pulse, the switching member 283 selects the row signal address generator 282 to feed the data Ao to the ROM 284. However, when not receiving the timing pulse, the calculation address generator 281 is selected to feed the 10 data Ac to the ROM 284.

In response to thus applied counted number data Ac and Ao, the ROM 284 simultaneously outputs "n" number of row vectors, starting from the position corresponding to the applied data Ac or Ao, in one row of the orthogonal matrix X. In other words, the ROM 284 outputs the row vector "n" times per one frame period base on the data Ao which is supplied from the row signal address generator 282. At the rested time during one frame period, the ROM 284 outputs another row vectors based on the data Ac which is supplied from the calculation address generator 281. A row vector data Sm (S3) including these two row vectors is transferred to the calculator 5 of the data converter 300.

Furthermore, a row latch 285 connected to the timing signal generator 286 and the ROM is provided for receiving the timing pulse and the row vector data Sm therefrom, respectively. In response to the timing pulse, the row latch 285 latches the row vector data Sm and then outputs thus latched data Sm later as a vector data S1 to the distributor 11 of the LCD driver 500. As a result, the calculator 5 is supplied with the row vector data Sm required for calculation, and the distributor 11 is supplied with the row vector data S1 required for producing the row signal.

Figure 12:
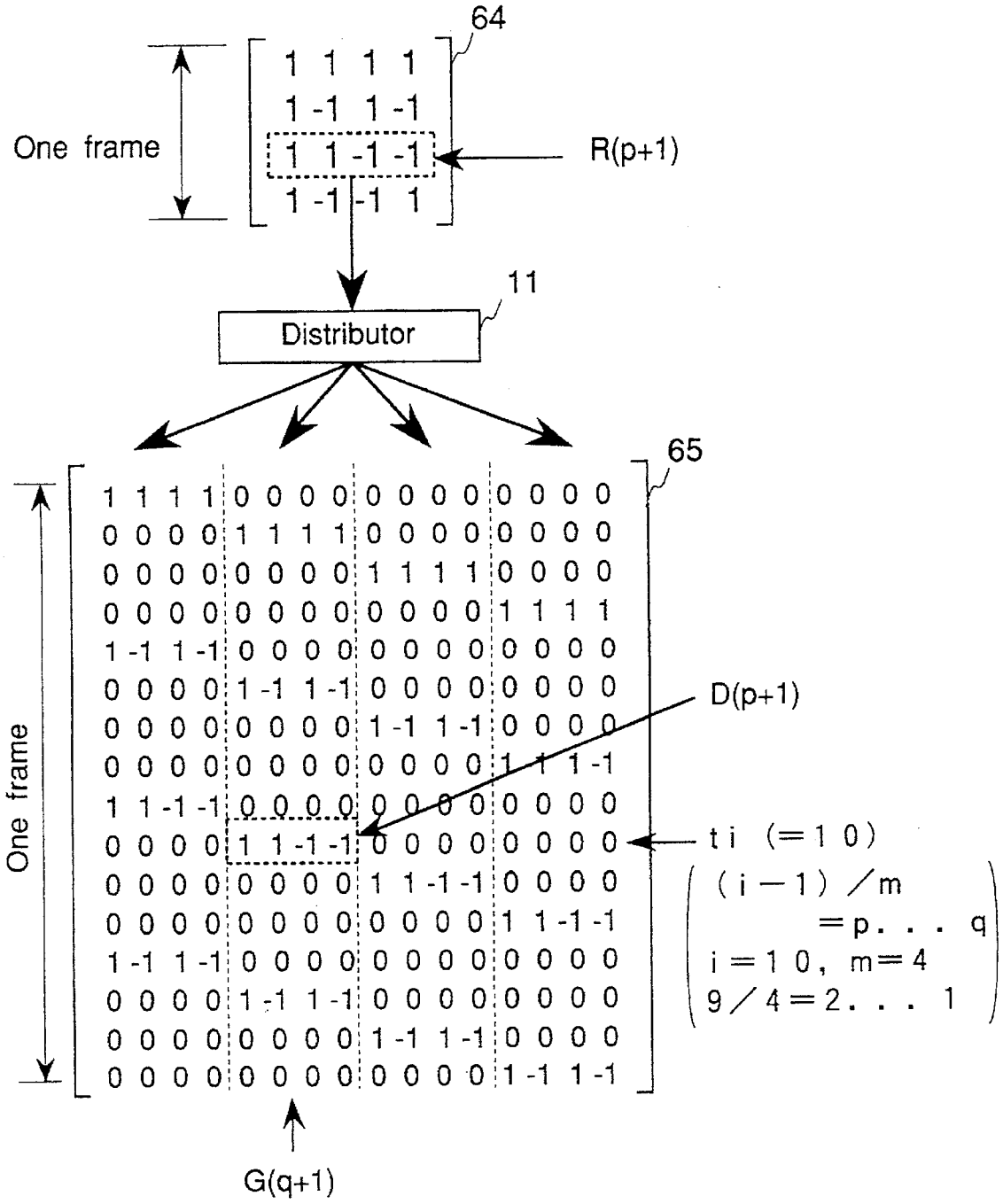
FIG. 12 is an illustration in assistance of explaining the operation of distributor of FIG. 1.

With reference to FIG. 12, the operation of the distributor 11 is described with respect to the row signal vector Si. In FIG. 12, an orthogonal matrix 64 is shown as an example of the orthogonal matrix X which is output by the matrix generator 3. All data in this matrix 64 are generated once a frame period. At time "i", the distributor 11 stores the (q+1)-th group of the row voltage register 12 with the data located on the (p+1)-th row of the matrix 64 and other group of register 12 with zero. Note that "p" and "q" can be obtained based on the equation (7) by knowing the value of "i". Therefore, when "i" is 10, it is known that "p" is 2 and "q" is 1. In other words, when "i" is 10, The second group of the row voltage register 12 stores the data located on the third row of the matrix 64, and other groups store zero at time 10. As a result, an orthogonal matrix 65 is generated during one frame period.

Figure 20:
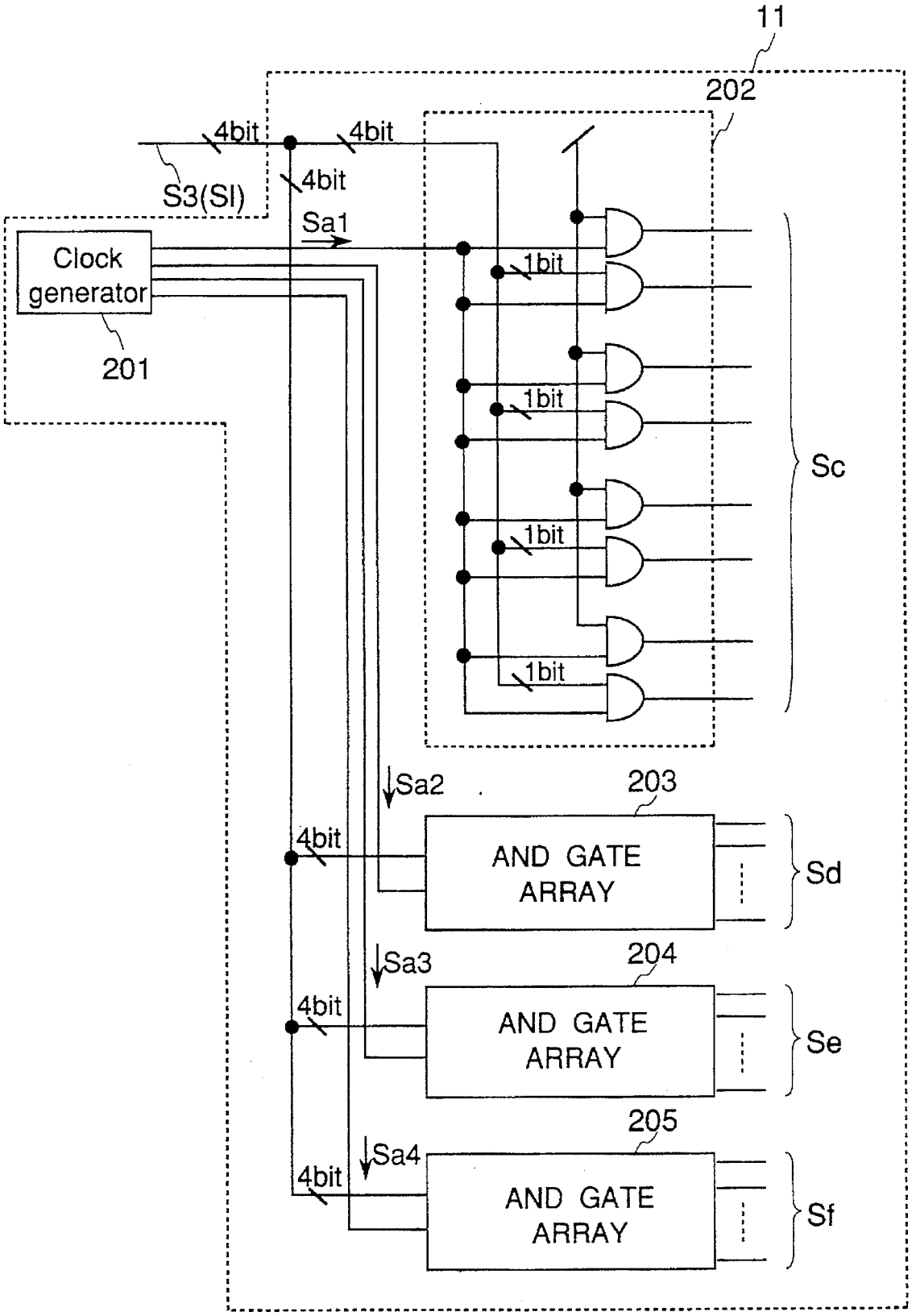
FIG. 20 is a block diagram showing the distributor of FIG. 1.
Figure 21:
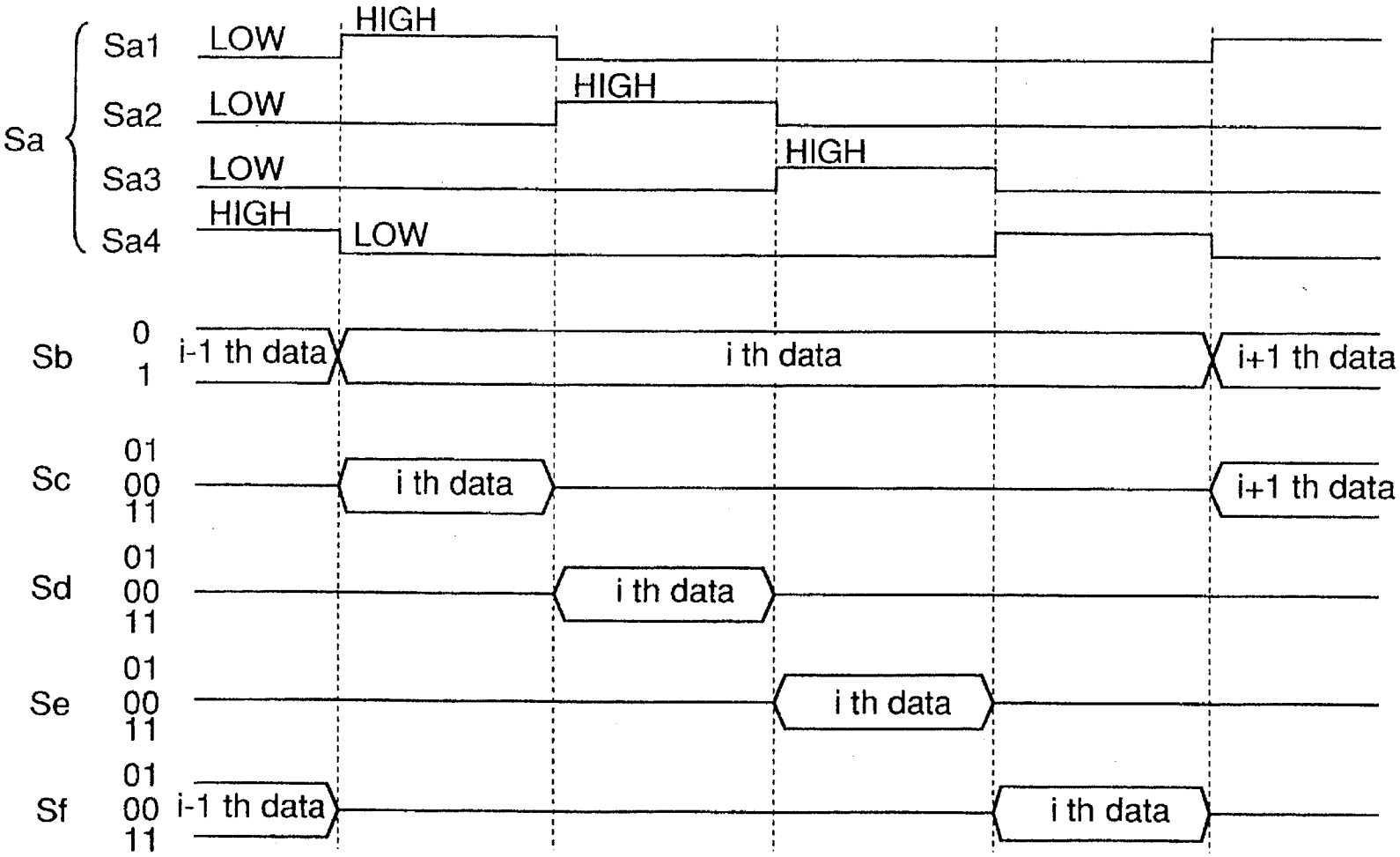
FIG. 21 is a graph showing various waveforms appeared in the distributor of FIG. 20.
Figure 22:
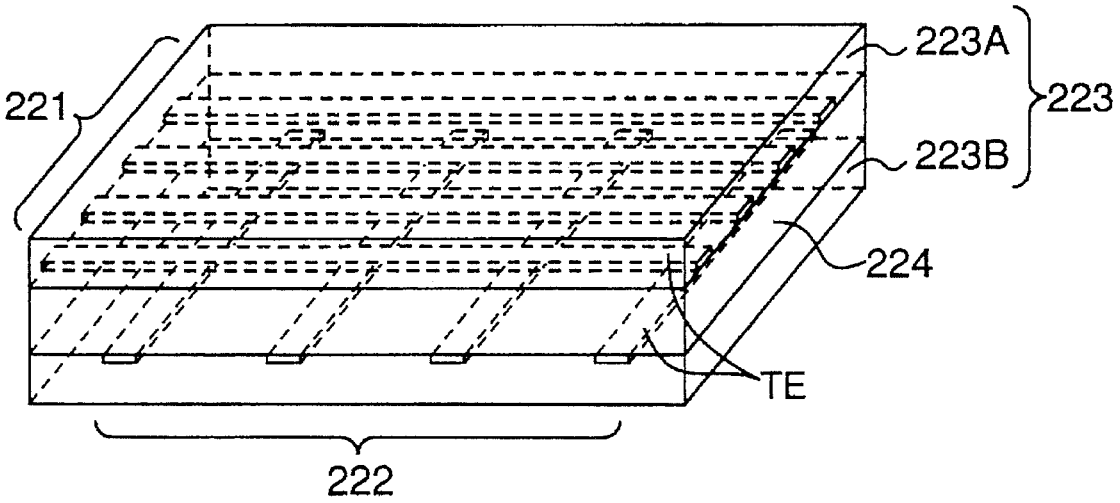
Fig.22 PRIOR ART
FIG. 22 is a perspective view schematically showing an STN passive matrix LCD.

With reference to FIGS. 20 and 21, the details of distributor 11 is further described. As best shown in FIG. 20, the distributor 11 has a four-phase clock generator 201 for generating a clock signal Sa having four phases Sa1, Sa2, Sa3, and Sa4 (FIG. 21), four AND gate arrays 202, 203, 204, and 205. Each AND gate array has an construction identical to that of the first AND gate array 202 which is specifically shown in FIG. 20. The fist AND gate array 202 has eight of AND gates each having two input terminals. One input terminal of each gate is connected to the clock generator 201 for receiving the first clock signal Sa1. Another input terminal of gates are alternately connected to different two common lines, as best shown in FIG. 20. One of two common lines is the line connected to the matrix generator 3 for receiving the row vectors S3 (S1) therefrom. Each output of AND gates forms a first signal Sc. Similarly, the second, third, and fourth AND gate arrays 203, 204, and 205 are connected to the clock generator 201 for receiving the second, third, and fourth phase signals Sa2, Sa3, and Sa4, respectively, and outputs a second, third, and fourth signals Sd, Se, and Sf, respectively.

Note that the row vectors S3 output from the matrix generator 3 are comprised of two binary digits "0" and "1". Data "1", "0", and "−1" included in the orthogonal matrix 65 are expressed in two bit as "01", "00", and "11", respectively. These two bit data are expressed by the output from two AND gates.

In the AND gate array 202, each of four AND gates for expressing the lower bits is always input with "1" to one of two input terminals thereof. To each of another input terminals of the four AND gates, the first clock signal Sa1 (FIG. 21) is input.

Each of rested four AND gates for expressing the upper bits is always input with "1" to one of two input terminals thereof, too. To each of another input terminals, each of bits in the vector data S1 from the matrix generator 3 is input.

Referring to FIG. 21, various wave forms of signals observed in the distributor 11 are shown. In the case that the first signal a1 is HIGH, the output from each of AND gates depends on the value of row vector S3 (not shown in FIG. 21), as follows. When the data of row vector S3 is zero, and one, the output is "01" and "11", respectively. However in the case that the signal is LOW, the AND gates always output zero. These are also effective for the combinations of other AND gates and signals Sa2, Sa3, and Sa4.

As a result, each data of row vectors S3 is output from four AND gate arrays 202, 203, 204, and 205 in order in response to the output Sa1, Sa2, Sa3, and Sa4 from the clock generator 201.

As best shown in FIG. 7, the frame buffer storage 7 is connected to column buffer storage 6 at the down stream position with respect to processing direction in this embodiment. However, even if the connection order of these two buffer storage 6 and 7 changed, the converted data buffer storage 400 can function effectively as before change the connection order.

Even if the column buffer storage 6 is modified to write the image data S300 in the correct order and to read out the data stored in the correct order from the first line in order, the column buffer storage 6 functions effectively as before such modification.

Furthermore, the distributor 11 having "L" number of AND gate arrays ("L" is an integer greater than one) can be constructed by applying such a clock generator 201 which can produces L phases.

Although the present invention has been fully described in connection with the preferred embodiments thereof with reference to the accompanying drawings, it is to be noted that various changes and modifications are apparent to those skilled in the art. Such changes and modifications are to be understood as included within the scope of the present invention as defined by the appended claims unless they depart therefrom.

What is claimed is:

1. A driving apparatus for driving a passive matrix liquid crystal display having a liquid crystal layer capable of responding to an effective voltage between a first electrode and a second electrode provided on the opposite sides, respectively, of said liquid crystal layer based on an image data comprised of a plurality of predetermined unit data formed in the form of a matrix, said apparatus comprising:

a first data arrangement means for storing said image data and outputting said stored image data column by column to produce a first arrangement image data having every element arranged in a first predetermined pattern;

a first matrix generating means for generating a first matrix;

a second matrix generating means for multiplying said first arrangement image data with said first matrix to produce a second matrix;

a second data arrangement means for storing said second matrix and outputting said stored second matrix row by row to produce a second arrangement image data having every element arranged in a second predetermined pattern; and an electrode signal producing means for producing a first signal based on a first matrix to apply to said first electrode and for producing a second signal based on said second arrangement image data to apply to said second electrode;

wherein said first matrix generating means includes a latch means for latching said first matrix to produce a third matrix.

2. A driving apparatus as claimed in claim 1, wherein said first data arrangement means comprises:

a first buffer memory means being able to store and read out one predetermined unit data of said image data therein and therefrom; and a second buffer memory means being able to store and read out at least one column of said image data therein and therefrom; and said second data arrangement means comprises:

a third buffer memory means being able to store and read out said second matrix column by column therein and therefrom; and a fourth buffer memory means being able to store and read out all of said columns of said second matrix therein and therefrom.

3. A driving apparatus as claimed in claim 2, wherein said first buffer memory means comprises a first address means for designating a first address to and from which said first buffer memory means simultaneously writes and reads each of said image data in first and second predetermined directions, respectively, said first and second predetermined directions being changed over every said predetermined unit data; and said second buffer memory means comprises a second address means for designating a second address to and from which said second buffer memory means writes said image data from said first buffer memory means and reads out said image data therefrom in a first order different from a second order in which said image data written therein.

4. A driving apparatus as claimed in claim 2, wherein said third buffer memory means comprises a third address means for designating a third address to and from which said third buffer memory means writes said second matrix and reads out said second matrix therefrom in a third order different from a fourth order in which said second matrix is written therein; and said fourth buffer memory means comprises a fourth address means for designating a fourth address to and from which said fourth buffer memory means simultaneously writes and reads each of said second matrix from said third buffer memory means in third and fourth predetermined directions, respectively, said third and fourth predetermined directions being changed over every said predetermined unit data.

5. A driving apparatus as claimed in claim 1, wherein said second matrix generating means divides said first arrangement image data into plural groups comprised of plural rows and multiplies each of said plural groups with said first matrix to produce said second matrix.

6. A driving apparatus as claimed in claim 2, wherein said first buffer memory means comprises a predetermined number of first storage means each being able to store a predetermined amount of said one predetermined unit data in a first predetermined speed; and said second buffer memory means comprises at least two second storage means each being able to store and read out at least one column of said image data in a second predetermined speed greater than said first predetermined speed.

7. A driving apparatus as claimed in claim 2, wherein said third buffer memory means comprises at least two third storage means each being able to store and read out at least one column of said second matrix in a third predetermined speed; and said fourth buffer memory means comprises a predetermined number of fourth storage means each being able to store a predetermined amount of said second matrix in a fourth predetermined speed smaller than said third predetermined speed.

* * * * *